US012410615B2

(12) United States Patent
Kelly

(10) Patent No.: US 12,410,615 B2
(45) Date of Patent: Sep. 9, 2025

(54) EXTENDABLE BEAM COUPLER

(71) Applicant: Quick Headers, LLC, Ogden, UT (US)

(72) Inventor: Scot Ryan Kelly, Huntsville, UT (US)

(73) Assignee: Quick Headers, LLC, Ogden, UT (US)

( * ) Notice: Subject to any disclaimer, the term of this patent is extended or adjusted under 35 U.S.C. 154(b) by 179 days.

(21) Appl. No.: 18/117,985

(22) Filed: Mar. 6, 2023

(65) Prior Publication Data

US 2024/0301694 A1 Sep. 12, 2024

(51) Int. Cl.
*E04C 3/04* (2006.01)
*E04C 3/02* (2006.01)

(52) U.S. Cl.
CPC ..... *E04C 3/04* (2013.01); *E04C 2003/023* (2013.01); *E04C 2003/0417* (2013.01)

(58) Field of Classification Search
CPC ..... E04C 3/04; E04C 3/005; E04C 2003/023; E04C 2003/0413; E04C 2003/0417; E04C 2003/0465; E04C 2003/0473; E04G 11/54; E04G 11/56
USPC ..... 52/204.2, 217, 632
See application file for complete search history.

(56) References Cited

U.S. PATENT DOCUMENTS 2,796,158 A 6/1957 Miles et al.
2,949,656 A 8/1960 Pleitgen et al.
2,974,762 A 3/1961 Hunnebeck
3,124,223 A * 3/1964 Kisovec ..... E04G 11/56 52/261
3,325,957 A 6/1967 Joist
4,121,804 A 10/1978 O'Leary
4,248,024 A 2/1981 Dahlstrom
5,459,967 A 10/1995 Bodtker
7,383,665 B2 6/2008 Frobosilo
7,546,718 B2 * 6/2009 Vasta ..... E04G 21/1841 52/645
8,261,509 B2 9/2012 Harkin
9,103,108 B2 8/2015 Lin
11,078,667 B2 * 8/2021 Kelly ..... E04C 3/07
2002/0074915 A1 6/2002 Shih
2003/0093959 A1 5/2003 Couture
2003/0213204 A1 * 11/2003 Belanger ..... E04B 2/7457 52/645

(Continued)

FOREIGN PATENT DOCUMENTS

CN 118007940 A * 5/2024
DE 580600 C * 7/1933

(Continued)

*Primary Examiner* — Ryan D Kwiecinski
(74) *Attorney, Agent, or Firm* — DENTONS Durham Jones Pinegar

(57) ABSTRACT

A system for traversing an opening of a construction element the system including a elongated housing with two extendable elements configured to reside at least partially within the housing. The extendable elements may extend beyond the housing and may include flanges or ledges which may engage the ends of a construction element, which may be a wall, and thus allow the system to traverse the opening of a construction element, such as a window or door. A coupler may be utilized to connect to a more than one elongated housing element to provide for traversal across even larger openings. The system may allow a user to easily manipulate the system to fit a plurality of openings and reuse the system a countless number of times.

18 Claims, 25 Drawing Sheets

(56) References Cited

U.S. PATENT DOCUMENTS

| | | | | |
|---|---|---|---|---|
| 2006/0010809 | A1 | 1/2006 | Lafreniere | |
| 2007/0089374 | A1* | 4/2007 | Vasta | E04C 3/07 52/204.2 |
| 2017/0073970 | A1 | 3/2017 | Weber | |
| 2017/0159284 | A1 | 6/2017 | Getz | |
| 2019/0048589 | A1* | 2/2019 | Kelly | E04C 3/07 |
| 2020/0385988 | A1* | 12/2020 | Kelly | E04C 3/005 |
| 2022/0018131 | A1* | 1/2022 | Sessler | E04B 2/76 |

FOREIGN PATENT DOCUMENTS

| | | | | | |
|---|---|---|---|---|---|
| DE | 840435 | C | | 7/1949 | |
| DE | 29516293 | U1 | | 12/1995 | |
| GB | 855048 | A | * | 11/1960 | |
| GB | 2481908 | A | * | 1/2012 | E04B 5/12 |
| KR | 20040021432 | A | | 3/2004 | |
| WO | 2003102321 | A1 | | 12/2003 | |
| WO | WO-2004111361 | A1 | * | 12/2004 | E04C 3/005 |

* cited by examiner

EXTENDABLE BEAM COUPLER

CROSS-REFERENCE TO RELATED APPLICATIONS

This application incorporates by reference U.S. patent application Ser. No. 15/672,143 entitled EXTENDABLE BEAM filed Aug. 8, 2017, now U.S. Pat. No. 10,280,618.

TECHNICAL FIELD

This disclosure relates generally to an extendable beam, methods, and systems for masonry or construction use in spanning and carrying a load of an opening. These systems relate more specifically to the use of a single beam over two vertical supports to create an opening, such as a window or doorway or other architectural element.

RELATED ART

In masonry, forms are often used to create windows, doorways or openings. These forms can be called many different things such as frames, bucks, headers, girders, joists, and the like. These forms are often made of simple wood (e.g., 2×4s or 2×6s) and built to (hopefully) fit within the space needed. Many times the wood frames are not the right size and have to be cut, fit, worked, and reworked until the proper dimensions of the frame is made. After the frame is constructed, a mason or other construction worker may begin building the next layer of block over the frame, the frame maintaining the opening.

These frames are costly and are typically limited to a one-time single use because of the opening size. Often installation and removal of these frames requires block repair and can interrupt a mason's job. A wood frame may also leave rough finishings and limit access through the opening while the frame is in place. Further, wood frames are not considered a very environmentally sensitive (or "green") practice.

Other devices include lintels. These lintels are supported by other support beams made of wood or metal that extend from the base of an opening to the lintel. These lintels may also include a single extendable portion that slides from a single side of the lintel so that the lintel may be used for different size openings. In one instance a lintel may include a first fixed shoulder that sits on one wall then a second extendable shoulder that sits on a different wall. The lintel rests on the two walls over an opening. These devices are only intended to telescope from a single side and may allow the lintel to nearly double its size.

SUMMARY

This disclosure, at least in one aspect, relates to a system or device with a longitudinal housing, which may be comprised of steel, a steel alloy, other metals or alloys, or a strong structure capable of holding significant weight (i.e., carbon fiber). The housing may be elongated with a U-shaped or C-shaped cross-section. The housing may hold, or may be capable of encompassing, at least one extendable member. The at least one extendable member may be two extendable members that each extend from the housing in opposite directions.

The housing may be forged, bent, milled, extruded or the like from a single piece of metal and may be forged with multiple bends (which bends may be 90°). The housing may also be welded with multiple pieces of metal at 90° angles or bends (or nearly 90° angels or bends) as well. The housing may include a first longitudinal wall that extends the length of the housing, a pair of second longitudinal walls that may be perpendicular to the first longitudinal wall and extend the length of the housing. A pair of third longitudinal walls, or pair of lips, that may be perpendicular to the pair of second longitudinal walls. The pair of lips may extend at least partially toward a longitudinal axis of the housing and the pair of lips may be parallel or close to parallel to the first longitudinal wall. At least one cross support post may extend between the pair of lips across a void in the housing securing the one lip to the second lip. The cross support post may be welded, forged or the like.

The system may comprise multiple configurations. In a first configuration the two extendable members may reside entirely within the housing. The two extendable members may be held within the housing by the pair of lips of the housing. Alternatively the two extendable members may be held by at least one support member which may be welded inside the housing. The at least one support member may be a plurality of support members. The plurality of support members may be secured, welded, formed, etc. to the pair of second longitudinal walls. The plurality of support members may be positioned opposite one another on the pair of second longitudinal walls. The plurality of support members may extend longitudinally at least partially along the pair of second longitudinal walls.

Alternatively, a separate retention element may be used to maintain the two extendable members. For instance, apertures may be milled, premanufactured, or drilled into lateral, or side, walls of the housing and allow for passage of a pin or rod. A slot may also be milled, ore premanufactured, into the side walls of the extendable members. Such slots may allow for extension of the extendable members within a range to prevent the complete withdrawal of the extension member from the housing.

The extendable members may be similar in shape and size and may be interchangeable. The extendable members may be forged or welded, and are separate from the housing. The extendable members may be substantially rectangular in shape and from one perspective may resemble a tray or open top box. Each extendable member may comprise a longitudinal axis, a first wall, a pair of second walls opposite each other, which may be parallel to each other, extending from the first wall at a 90° angle, and a pair of third walls opposite each other, and which may be parallel to each other, extending from the first wall at a 90° angle and connected to the pair of second walls.

The pair of second walls may be different lengths extending from the first wall. The distal wall of the pair of second walls, may be shorter in length than the proximal wall. The proximal wall may be longer and may engage the plurality of support members of the housing to act as a stop such that the extendable members may not extend out of the housing beyond a predetermined or predesignated distance or amount. An extendable member flange, or tab, may extend distally from the distal wall of the pair of second walls. The extendable flange may be configured to engage a wall or support for the system to rest on.

The pair of third walls may be substantially parallel and may be substantially the same length and width. The pair of third walls may provide a slide or guide to glide along the plurality of support members while the extendable members are manipulated at different positions relative to the housing.

A second configuration may be both extendable members extending beyond the housing exposing each flange of each extendable member to engage the construction element (e.g., walls or supports) that traverses an opening of the construction element. In a third configuration at least one of the extendable members may extend at least partially beyond the housing, exposing at least one flange from the extendable member to engage a wall or support of the construction while the other extendable member only protrudes from the housing far enough to expose a flange to engage the construction element.

Additionally, the extendable member may further include variable flanges extending from distal ends of the extendable members. Different angles of flanges with different depths are considered and may be utilized for different angles of intersecting walls.

Disclosed systems may also include a coupler to couple, connect, or daisy-chain multiple housings and extendable members together. Such coupling allows the systems to traverse large openings of a structure. In a first configuration, the coupler may be substantially rectangular and linear. In a second configuration, the coupler may include an angle, such as a 90° angle, allowing the coupler and the housings to traverse non-linear openings and/or corners of structures.

The system may comprise or resemble a lintel or header and may be configured to traverse an opening of a structure, such as a door or window for a building that is being constructed.

DETAILED DESCRIPTION

Figure 1:
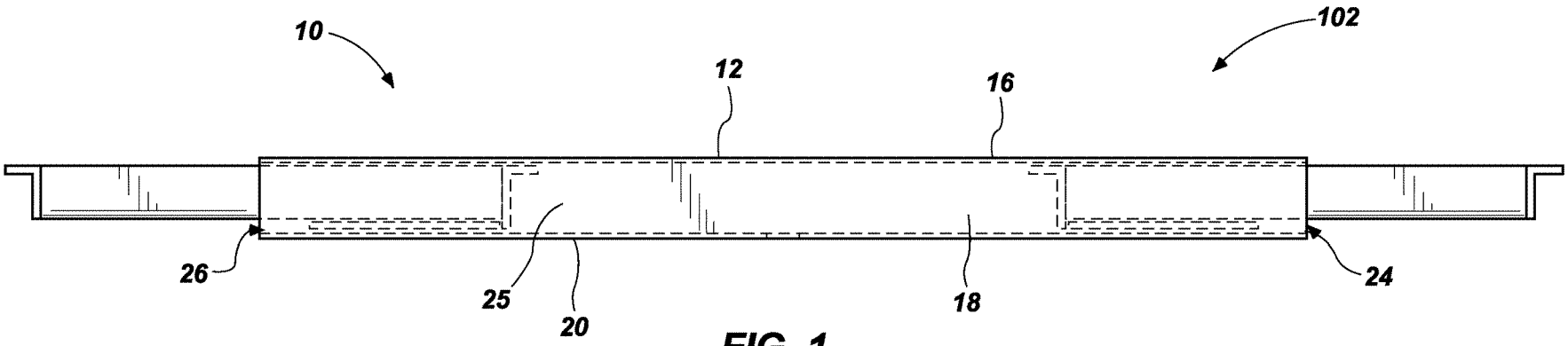
FIG. 1 illustrates a side view of a system in a second configuration with a housing and two extendable members extended from the housing.
Figure 2:
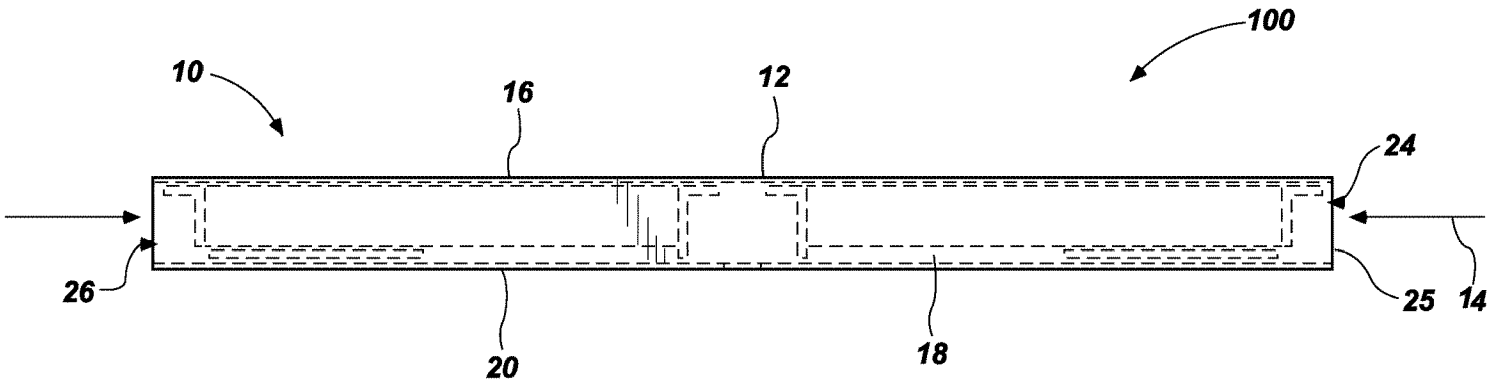
FIG. 2 illustrates a side view of the system of FIG. 1 in a first configuration with the two extendable members retracted within the housing.

FIGS. 1 and 2 illustrate side views of at least one embodiment of device or system 10 which may be a horizontal support member, a lintel, a beam or the like. In the industry these systems may be referred to as "bucks" or "headers." Other references to the system 10 may be a "frame" as well. The system 10 may include a housing 12 which may be a single piece of metal, often steel, that is forged into a U-shaped or C-shaped configuration. The housing 12 may be manipulated with bends in the housing for optimum use by a mason (for purposes of this disclosure a "mason" may be a construction worker, mason, brick layer, stone layer, block layer or similar). The housing 12 may be a longitudinal member which may be substantially rectangular in shape from a plurality of views. A longitudinal axis 14 may extend the length of the housing (see, e.g., FIG. 3).

The housing 12 may include a first wall 16, which may be substantially planar, extending a length and a width of the housing 12. The first wall 16 may be substantially flat and configured to allow other flat elements (i.e. bricks, blocks, etc.) to easily reside on the first wall 16. The first wall 16 may include bends or curves toward each width end of the first wall 16. A pair of second walls 18, 18' may extend from the first wall 16, or the bends of the first wall 16, in a direction substantially perpendicular to the first wall 16. Extending from the pair of second walls 18, 18' are a pair of third walls 20, 20' that may extend from separate bends in the second walls 18, 18'. The pair of third walls 20, 20' may extend toward each other and the longitudinal axis 14, or midline, of the longitudinal housing 12. A channel 25 may be positioned between the pair of third walls 20, 20' and run the length of the housing 12. The third walls 20, 20' may be substantially parallel to the first wall 16. The channel 25, or passage or void, may run the length of the housing. A cross-sectional shape of the housing 12 may resemble a C-shape or U-shape.

The housing 12 may include a first opening 24 toward one end of the housing 12 and a second opening 26 toward a second, opposing end of the housing 12 with the channel 25 running from the first opening 24 to the second opening 26.

The housing 12 may be comprised of a single piece of metal or steel, and may be forged of a single piece of metal. The single piece of metal can be forged with the bends in the walls as described earlier, which allows for greater strength of the housing 12 rather than welding the walls together at weld points. However, it will be appreciated that the system 10 may be welded together with multiple metal pieces. In the instance of welding, the "bends" may be sharper, more defined, and not as curved. Additionally, and/or alternatively, the welds may be ground or sanded down to form similar bends as though the housing 12 was forged from a single piece of metal.

Figure 3:
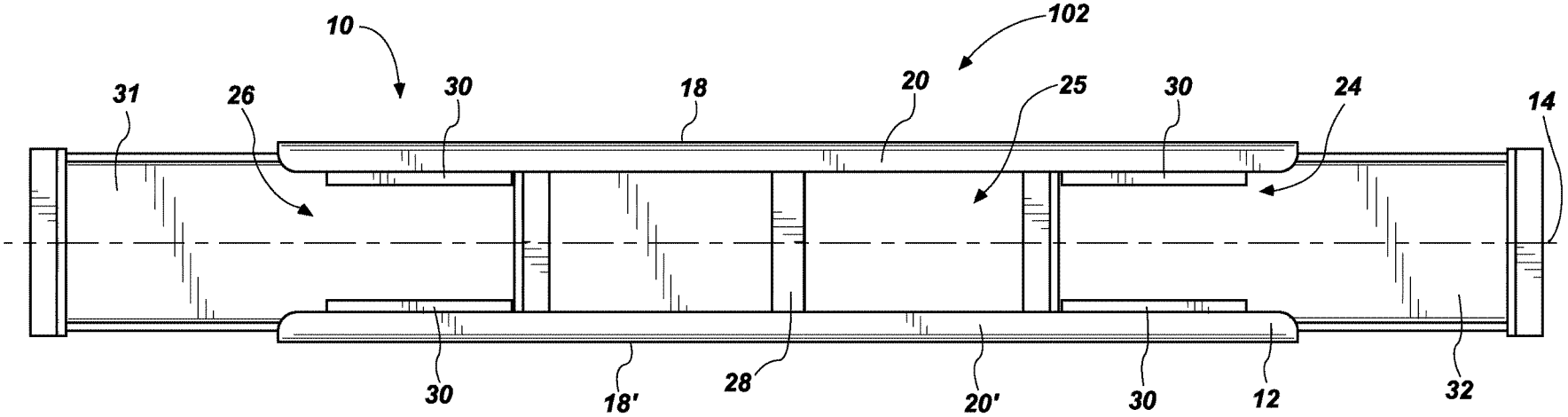
FIG. 3 illustrates a bottom view of the system of FIG. 1 with a first extendable member and a second extendable member in the second configuration.
Figure 4:
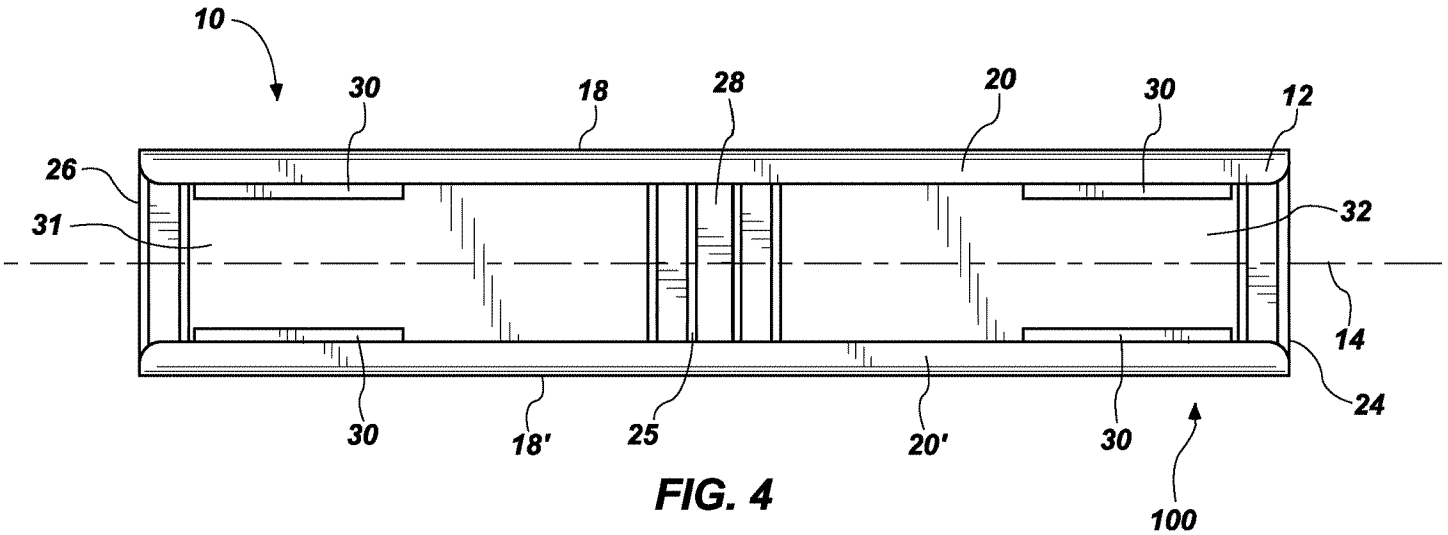
FIG. 4 illustrates a bottom perspective view of the system of FIG. 1 with a first extendable member and a second extendable member in the first configuration.

Referring to FIGS. 3 and 4, a cross-bar 28 may extend from the third walls 20, 20' across the channel 25. The cross-bar 28 may provide greater structural integrity to the system 10, and specifically the housing 12, to maintain the housing 12 shape and to allow the system 10 to carry heavier loads. More than one cross-bar 28 may be utilized and may be commensurate with a ratio of the length of the housing 12. The cross-bar(s) 28 may be positioned within the housing 12 and/or across the channel 25 depending on the length of the housing 12.

A plurality of support members 30 may be positioned and secured to the housing 12 on the interior of the second walls 18, 18' and within the channel 25. Securing of the support members 30 may be accomplished by welding the pieces into place. The plurality of support members 30 may be positioned opposite one another on the pair of second walls 18, 18' and at multiple locations along the pair of second walls 18, 18'. For example, support members 30 may be secured at different longitudinal positions along the interior of the second walls 18, 18'. The plurality of support members 30 may extend longitudinally at least partially along the pair of second walls 18, 18', provide additional support, and may operate as a guide or track for extendable members. The support members 30 may also be planar, or flat, with the plan of the support members running substantially parallel to the first wall 16 of the housing 12.

Figure 6:
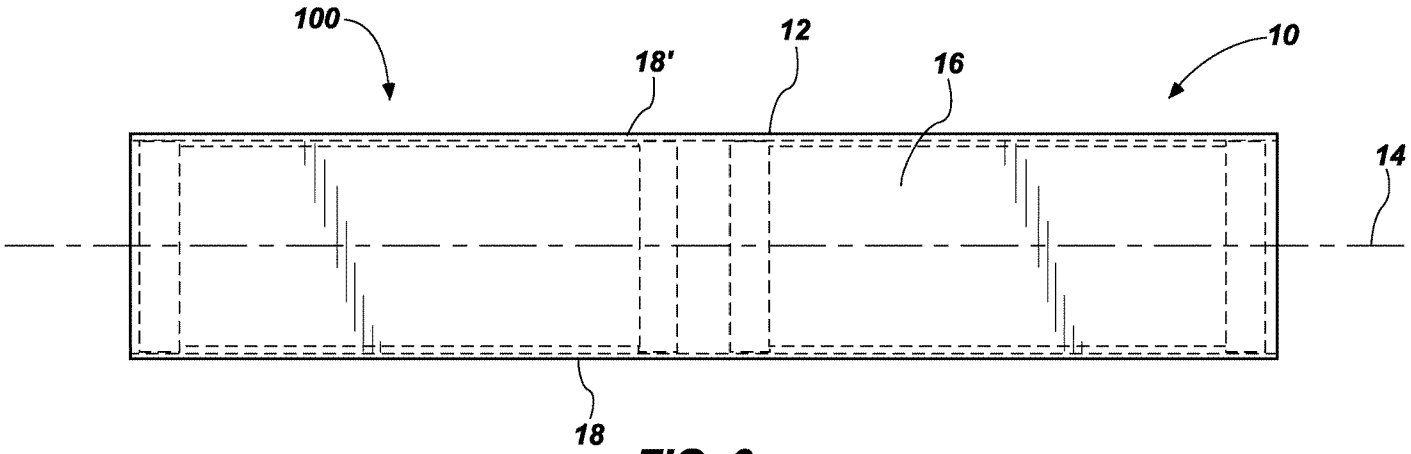
FIG. 6 illustrates a top view of the system of FIG. 1 in the first configuration.

Referring to FIGS. 4 and 6, a first configuration 100 shows a first extendable member 32 and a second extendable member 31 in a retracted position within the channel 25, wherein the first and second extendable members 32, 31 are positioned within the housing 12. The first and second extendable members 32, 31 are configured to slide longitudinally within the channel 25 and along the support members 30. The first and second extendable members 32, 31 may exit the first and second openings 24, 26, respectively. The first extendable member 32 is configured to reversibly slide away from the second extendable member 31 and vice versa.

Referring to FIG. 3, a second configuration 102 shows the first and second extendable members 32, 31 protruding from and extending from the housing 12. First extendable member 32 extends along the same longitudinal axis as the housing axis 14 and in the opposite direction of the second extendable member 31.

Figure 5:
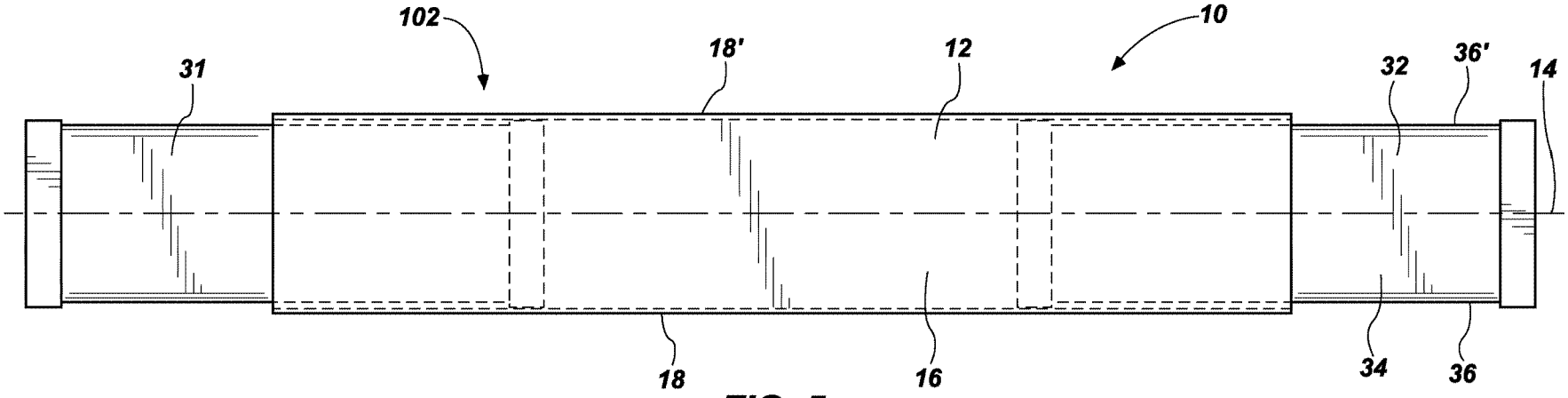
FIG. 5 illustrates a top view of the system of FIG. 1 in the second configuration.

Referring to FIGS. 3 and 5, the first extendable member 32 extends from the housing 12 in a longitudinal direction and along the same longitudinal axis 14 as the housing 12. The first extendable member 32 is configured to fit at least partially within the housing 12 and may fit entirely within the housing 12. The first extendable member 32 includes a body with a planar first wall 34 that may run substantially parallel to the first wall 16 of the housing. On the two lateral sides of the planar first wall 34, two extendable member second walls 36, 36', opposite each other, may extend from the planar first wall 34 at approximately 90°. The two extendable member second walls 36, 36' may engage the support members 30 with the walls 36, 36' gliding or sliding along the support members 30. Alternatively, the two extendable member second walls 36, 36' may engage and glide or slide along the third walls 20, 20' of the housing 12. It is to be understood that the second extendable member 31 similarly includes a planar first wall and two opposing extendable member second walls disposed on lateral sides of the planar first wall. Further, the second extendable member 31 may similarly engage the support members 30 and/or the third walls 20, 20' of the housing 12.

Figure 7:
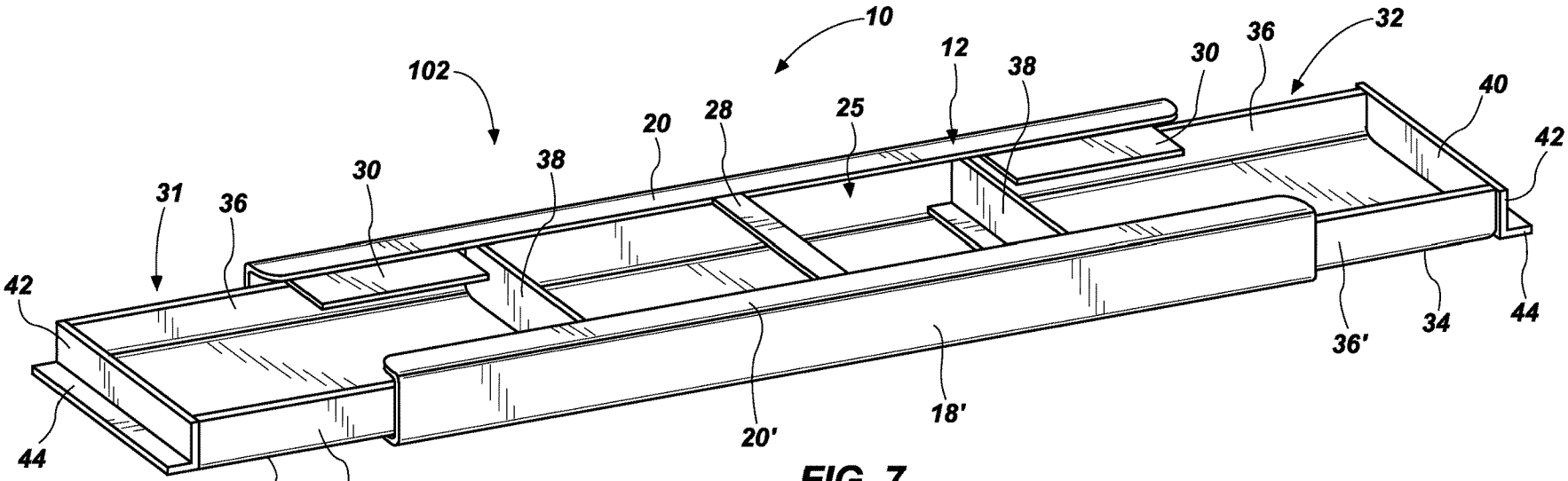
FIG. 7 illustrates a bottom perspective view of the system of FIG. 1 with a first extendable member and a second extendable member in the second configuration.
Figure 8:
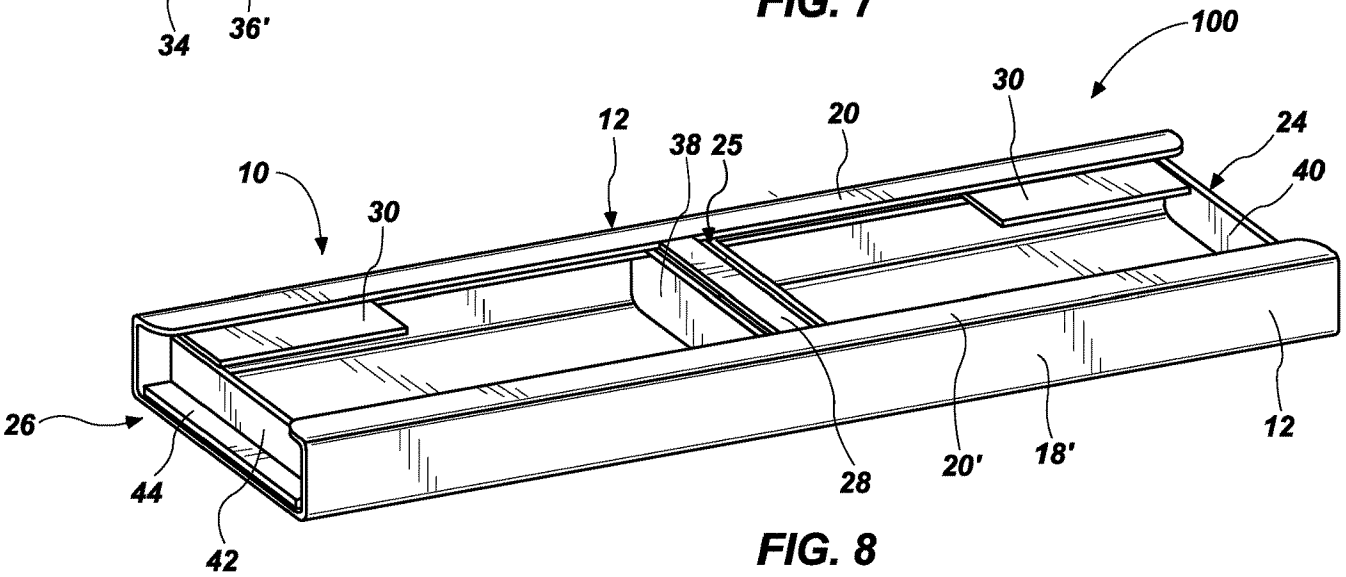
FIG. 8 illustrates a bottom perspective view of the system of FIG. 1 with a first extendable member and a second extendable member in the first configuration.

Referring to FIGS. 7 and 8, the first extendable member 32 may be substantially rectangular in shape and, from one perspective, may resemble a tray or open top box. The first extendable member 32 may comprise a proximal wall 38 and a distal wall 40, opposite each other, and which may be substantially parallel to each other. The proximal and distal walls 38, 40 can extend from the first planar wall 34 at about a 90° angle and can be connected to the pair of extendable member second walls 36, 36'.

The proximal wall 38 may extend further from the planar first wall 34 than the distal wall 40. The proximal wall 38 may extend further than the extendable member second walls 36, 36' as well. The proximal wall 38 may provide a stop against a proximal end of the support members 30, so that the first extendable member 32 does not extend too far out of the housing 12. The distal wall 40 may include a distal tip 42 which may include a flange 44, or tab, which extends longitudinally from the distal wall 40 in the same plane or parallel plane as the planar first wall 34. The distal tip 42 may be integrated into the body of the first extendable member 32 or may be a separate piece that may be secured, or welded, to the distal wall 40. The distal tip 42 may include a right angle piece, or elbow, that in one plane sits flush against the distal wall 40. In a separate plane perpendicular to the one plane sitting flush against the distal wall 40, the distal tip 42 may extend in a same plane, substantially the same plane, or a parallel plane to the first planar wall 34, which extension may be the flange 44. The flange 44 engages a construction element 50, which may be a wall or support, and rests on that construction element 50 which holds up the system 10 (see, e.g., FIG. 9).

Each extendable member 32, 31 may extend from the housing 12 at least as far as half of the length of the extendable members 32, 31. Each extendable member 32, 31 may extend just far enough for the flange 44 to protrude from the housing 12 to engage one edge of an opening (see FIG. 9). Each extendable member 32, 31 may extend as far as required to traverse the opening with the appropriate length of housing 12. The distance each extendable member 32, 31 extends is roughly infinite because each member 32, 31 can slide to any number of positions from the flange 44 extending until the extendable member 32, 31 hits the stop or the support member 30.

The first extendable member 32 may be manufactured, or forged, from a single metal piece or it may be welded from multiple metal pieces. Additionally, the first extendable member 32 may complementarily fit within the housing 12, such that the curved edges/corners of the housing 12 (e.g., between the first wall 16 and the second walls 18, 18') may correspond to similar curvatures in the first extendable member 32 (e.g., between the planar first wall 34 and the extendable member second walls 36, 36'). This complementary fit may allow for ease in sliding the first extendable member 32 out of the housing 12, as well as retracting the first extendable member 32 back into the housing 12.

The second extendable member 31 may be substantially identical to the first extendable member 32. The same elements are utilized in the second extendable member 31 with the same features other than the second extendable member 31 extends from the opposite side of the housing 12 and in an opposing direction than the first extendable member 32.

The extendable members 32, 31 may extend from a fraction of one inch (e.g., ¼, ½, ⅓ inch) to up to 12 inches from the housing 12. The length of the entire system 10 may vary from 1.5 feet (18 inches) up to 42 feet and perhaps even longer. The housing 12 may be the majority of the length of the system 10 while the extendable members 32, 31 remain roughly the same size, regardless of the housing 12 size. However, it is contemplated that the extendable members size or length 32, 31 may increase proportionately to the housing 12 size.

Depending on the length of the system 10 utilized, for the system 10 to traverse an opening in a construction element 50, posts, post shores, or props may be required to engage the system 10 at one or more locations. The posts may engage the system 10 on a bottom side, or within the channel 25 side of the housing 12 at strategic locations in the opening of the construction element 50.

Figure 9:
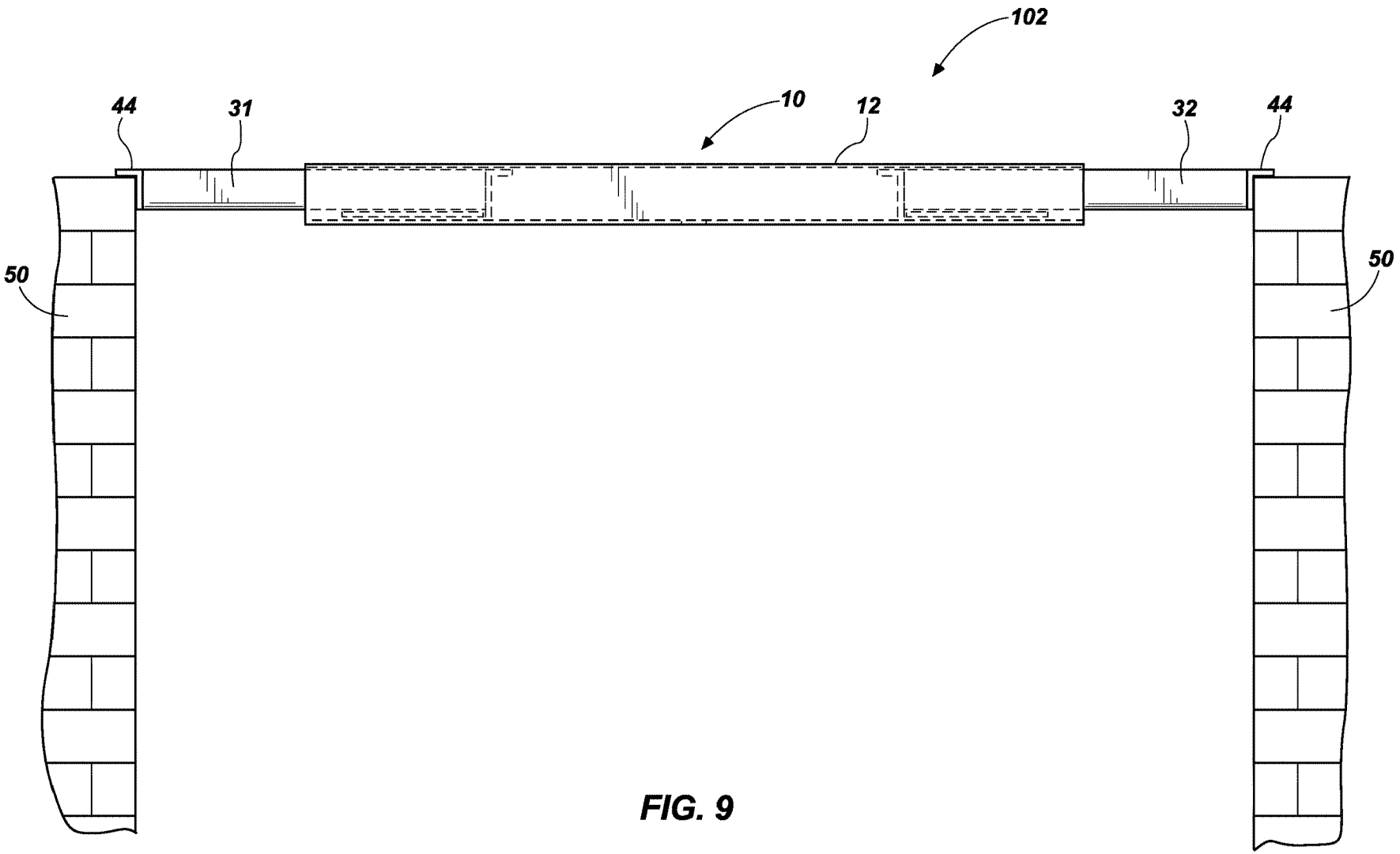
FIG. 9 illustrates the system of FIG. 1 traversing an opening of a construction element.

Referring to FIG. 9, one method of use for the system 10 includes identifying the system 10 (with the extendable members 31, 32 in a first configuration within the housing 12) that would easily fit within a construction element opening. The method of use can also include extending at least one of the extendable members 31, 32 to expose at least one flange 44 to engage the edge of the opening. The method can also include positioning the system 10 across the opening, typically horizontally across the opening, and extending the other of the extendable members 31, 32 to expose the other flange 44 to engage the opposite edge of the same opening. The system 10, when extended across the opening, is in a second configuration.

Figure 10:
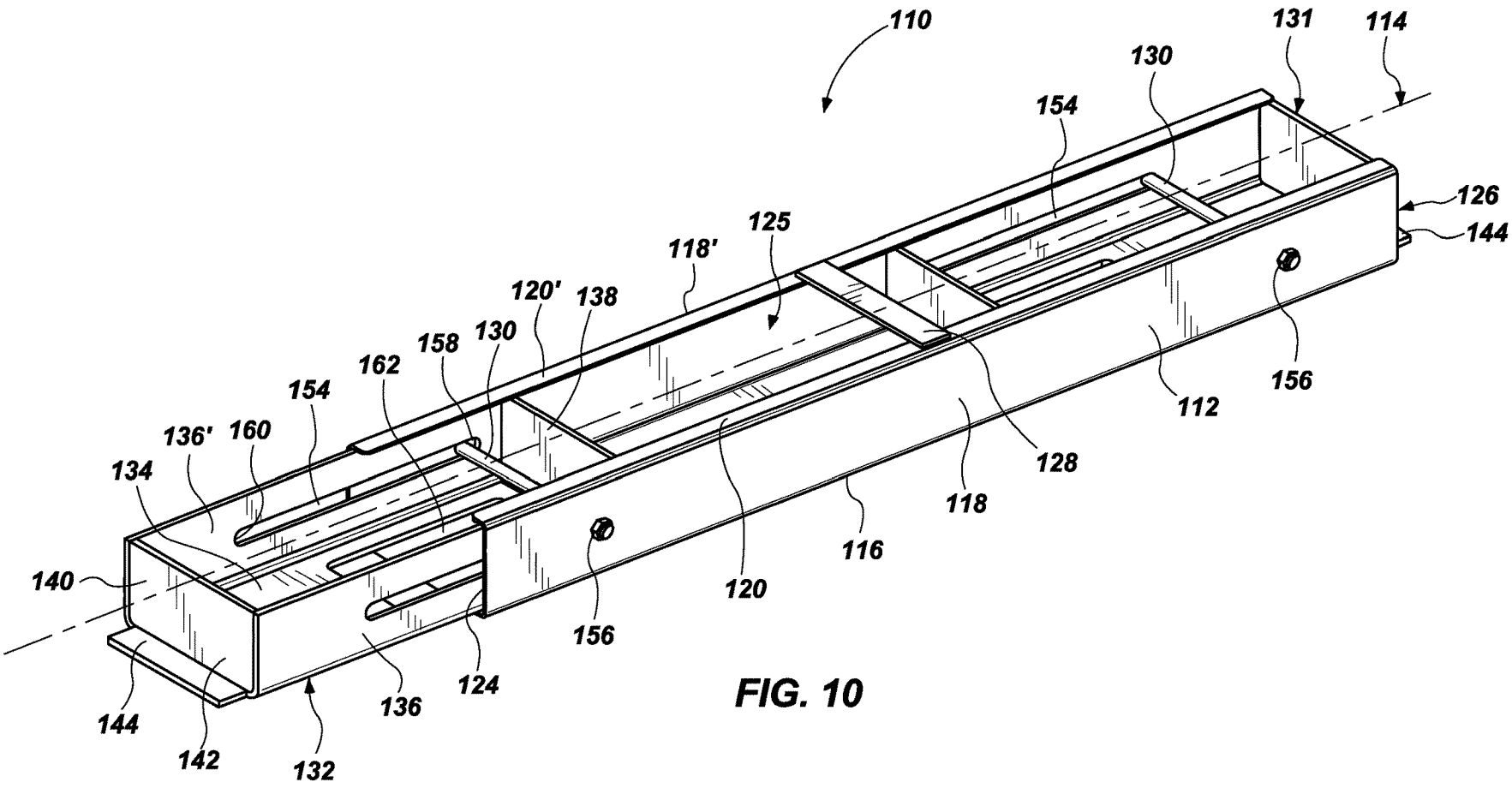
FIG. 10 illustrates a perspective view separate embodiment of the system of FIG. 1 with a pin, extendable members with slots and a window, with one extendable member at least partially extended.
Figures 11, 12, 13:
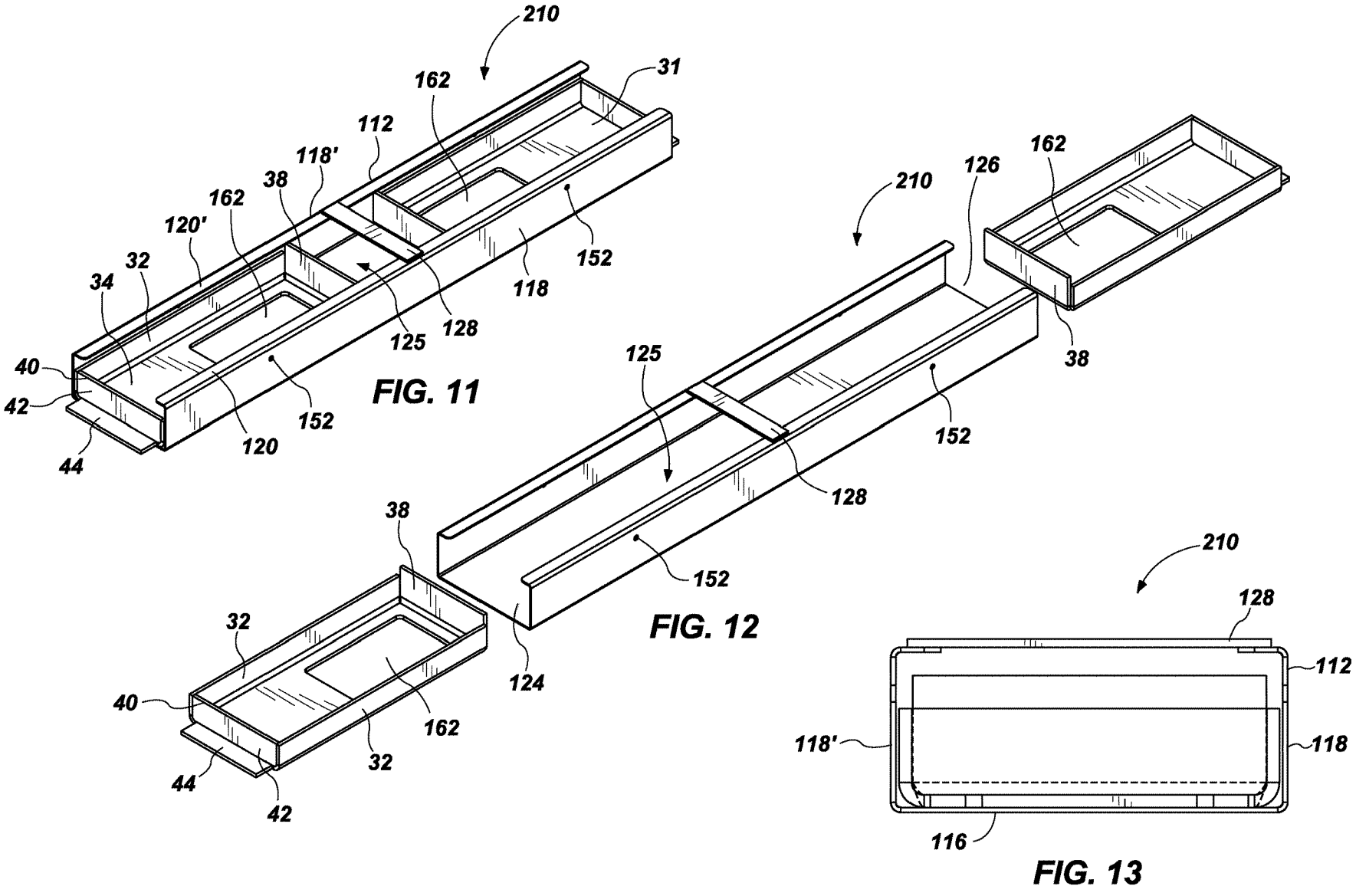
FIG. 11 illustrates a perspective view of the system of FIG. 10 with two extendable members without slots within the housing.
FIG. 12 illustrates a perspective view of the system of FIG. 11 with the extendable members removed from the housing.
FIG. 13 illustrates a side view of the system of FIG. 11.
Figure 14:
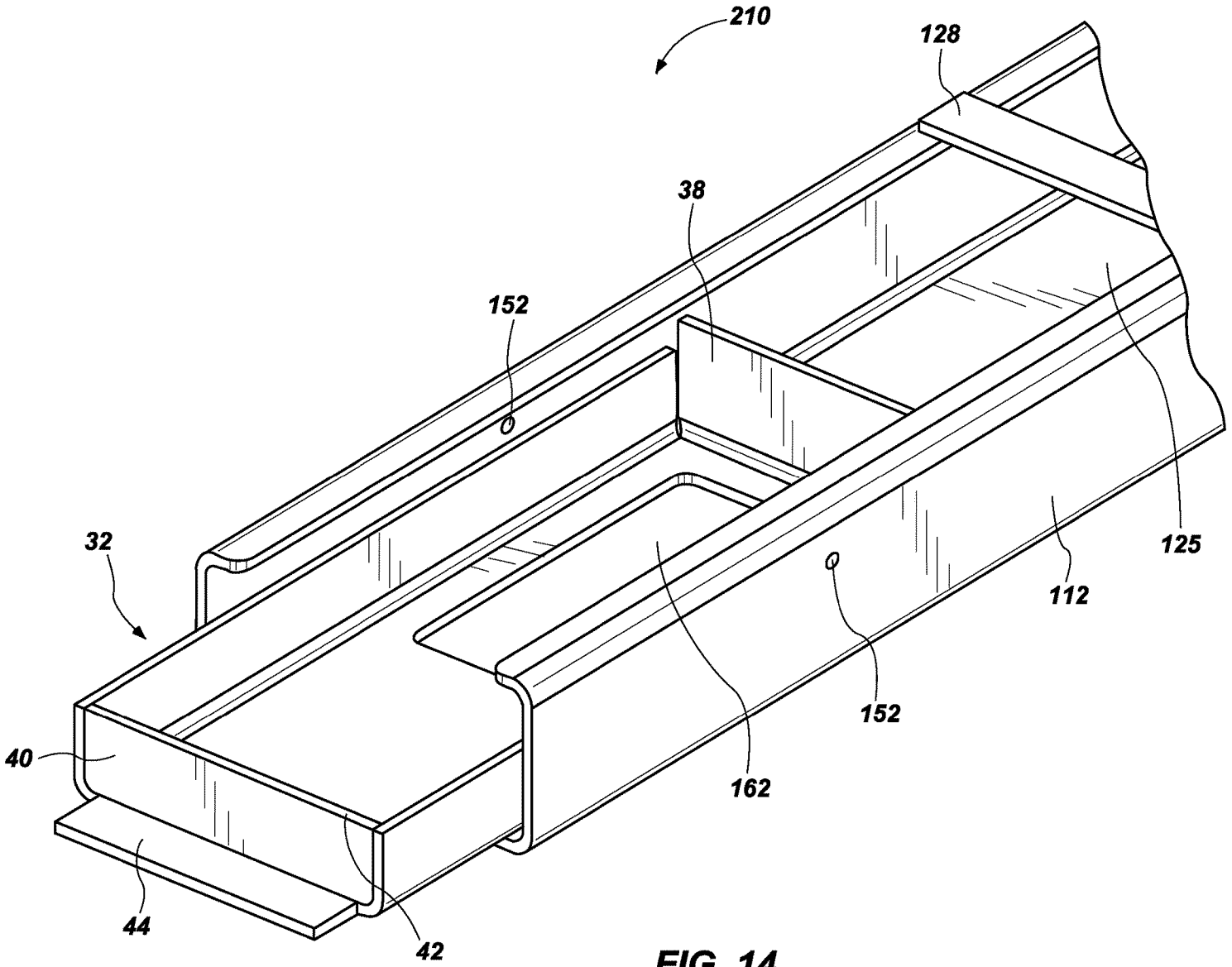
FIG. 14 illustrates a magnified partial perspective view of the system of FIG. 11.
Figure 15:
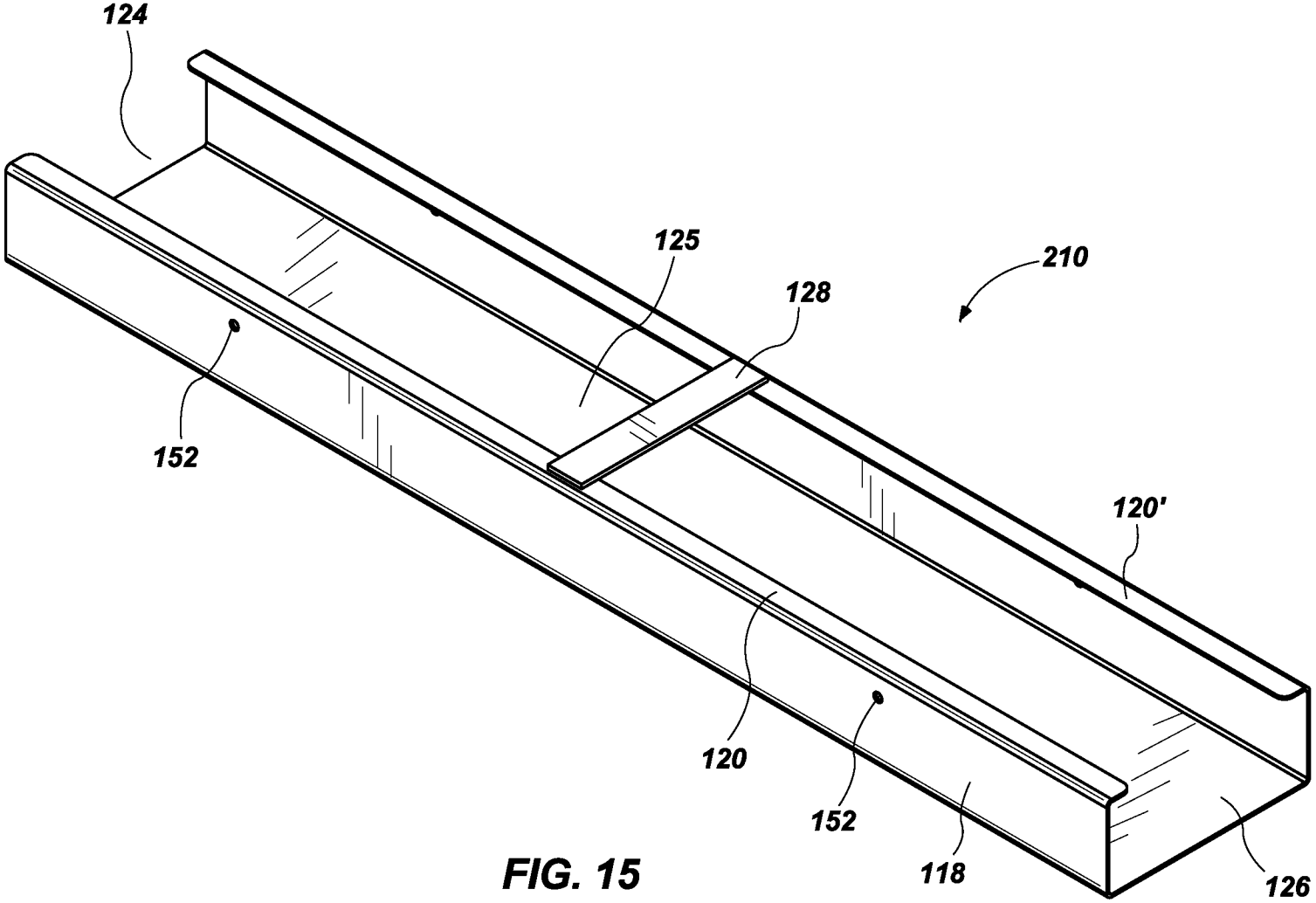
FIG. 15 illustrates a perspective view of the housing of FIG. 10.
Figure 16:
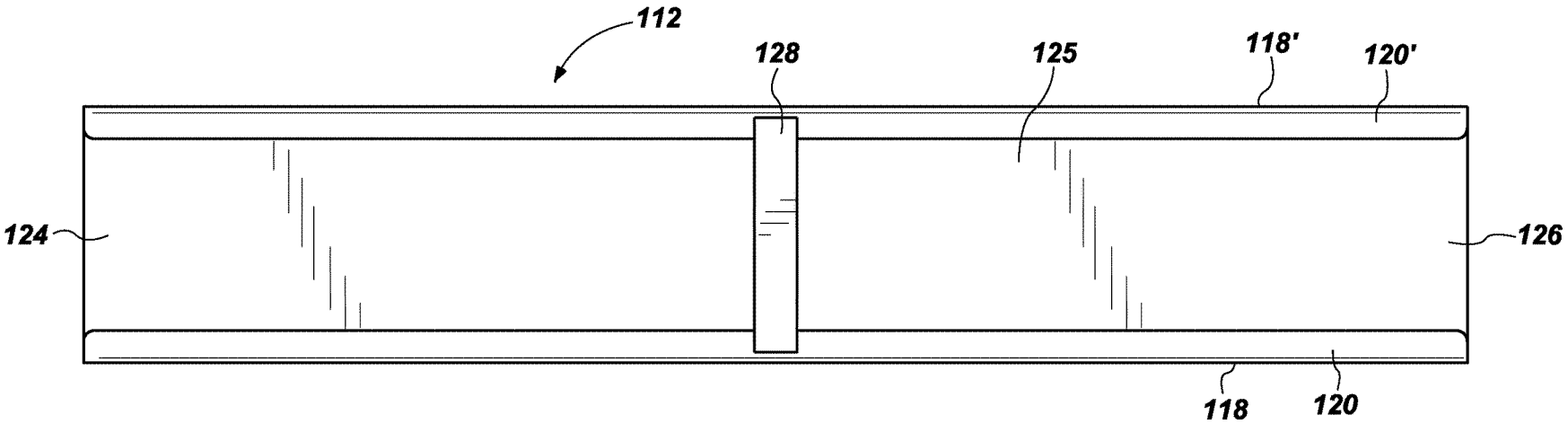
FIG. 16 illustrates a bottom view of the housing of FIG. 10.
Figure 17:
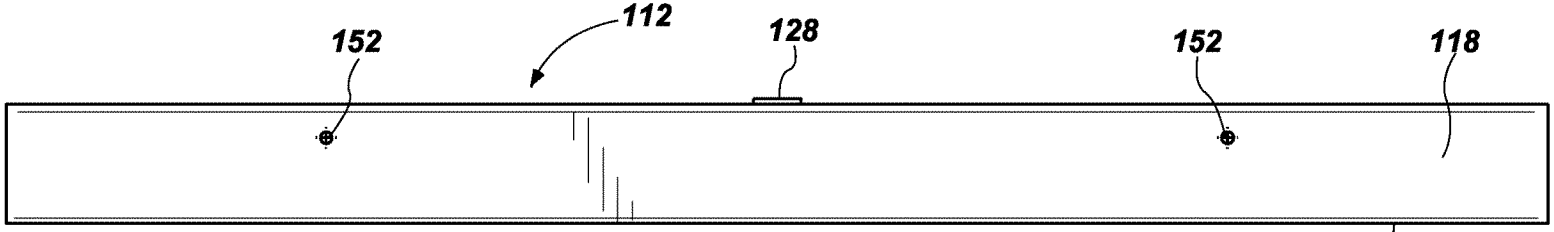
FIG. 17 illustrates a lateral side view of the housing of FIG. 10.
Figure 18:
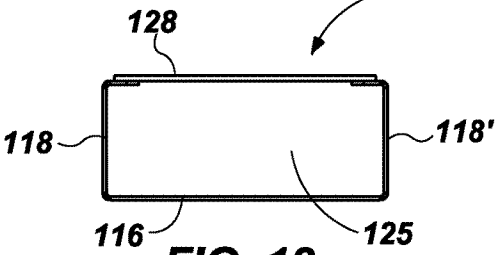
FIG. 18 illustrates a longitudinal side view of the housing of FIG. 10.
Figure 19:
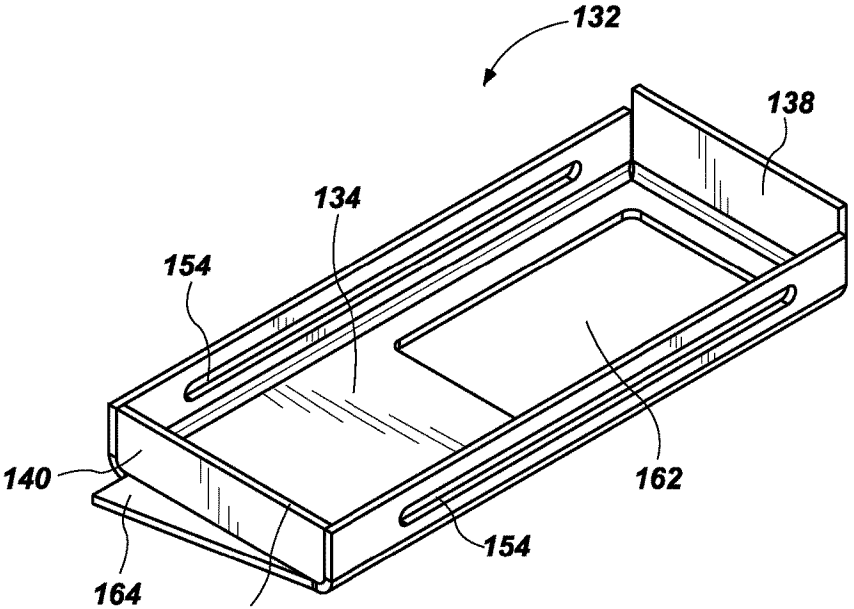
FIG. 19 illustrates a perspective view of an alternate embodiment of an extendable member with slots and an angled flange.
Figure 22:
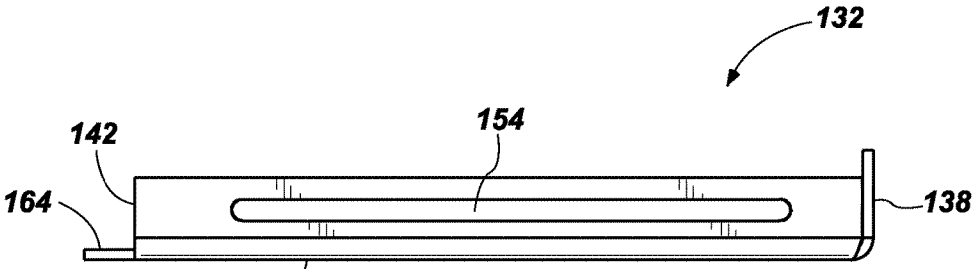
FIG. 22 illustrates a lateral side view of the extendable member of FIG. 19.
Figure 20:
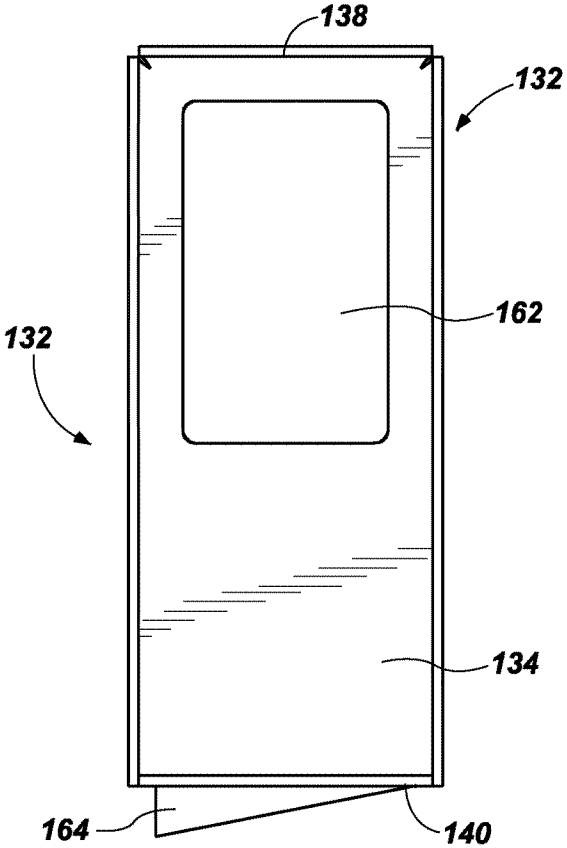
FIG. 20 illustrates a bottom view of the extendable member of FIG. 19.
Figure 21:
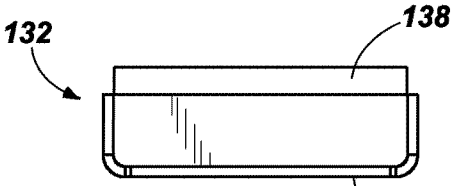
FIG. 21 illustrates a longitudinal side view of the extendable member of FIG. 19.
Figure 23:
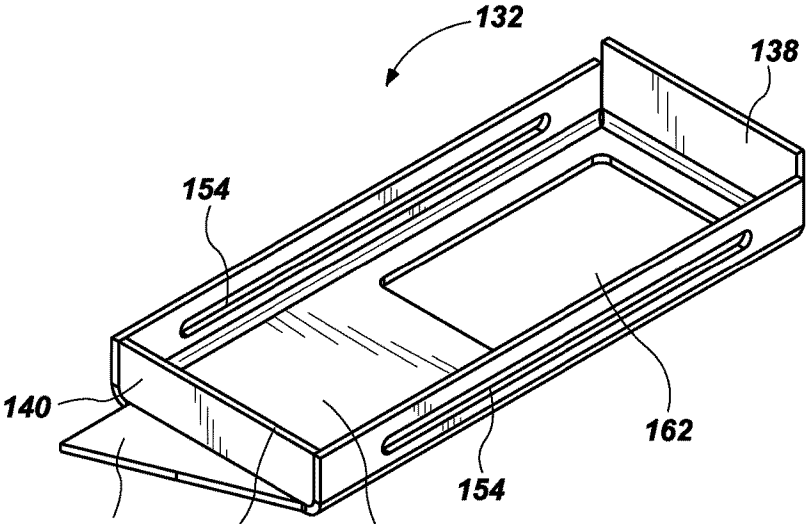
FIG. 23 illustrates a perspective view of an alternate embodiment of an extendable member with slots and with a different angled flange.
Figure 26:
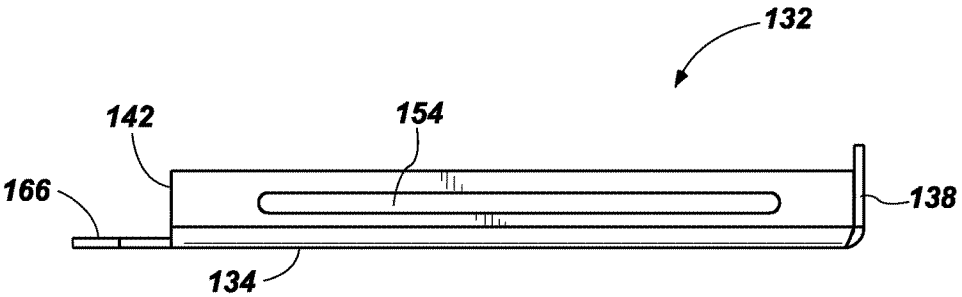
FIG. 26 illustrates a lateral side view of the extendable member of FIG. 23.
Figure 24:
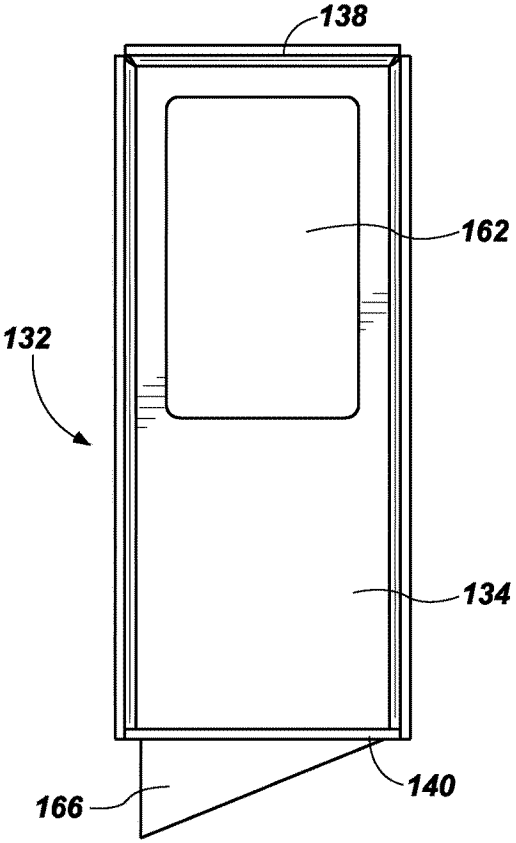
FIG. 24 illustrates a bottom view of the extendable member of FIG. 23.
Figure 25:
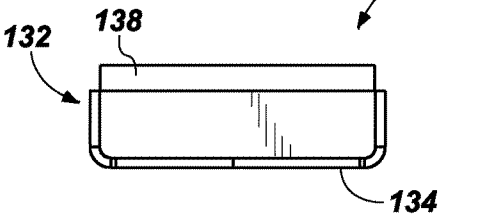
FIG. 25 illustrates a longitudinal side view of the extendable member of FIG. 23.
Figure 27:
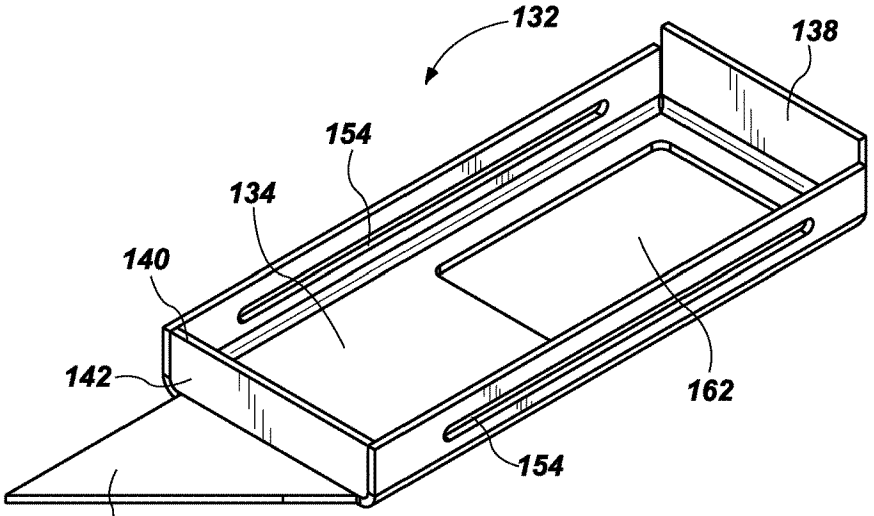
FIG. 27 illustrates a perspective view of an alternate embodiment of an extendable member with slots and with a different angled flange.
Figure 30:
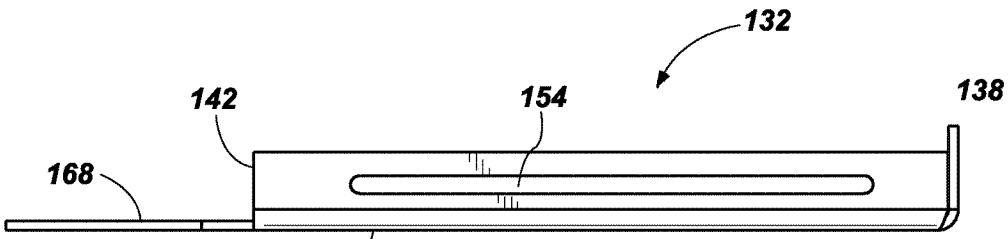
FIG. 30 illustrates a lateral side view of the extendable member of FIG. 27.
Figure 28:
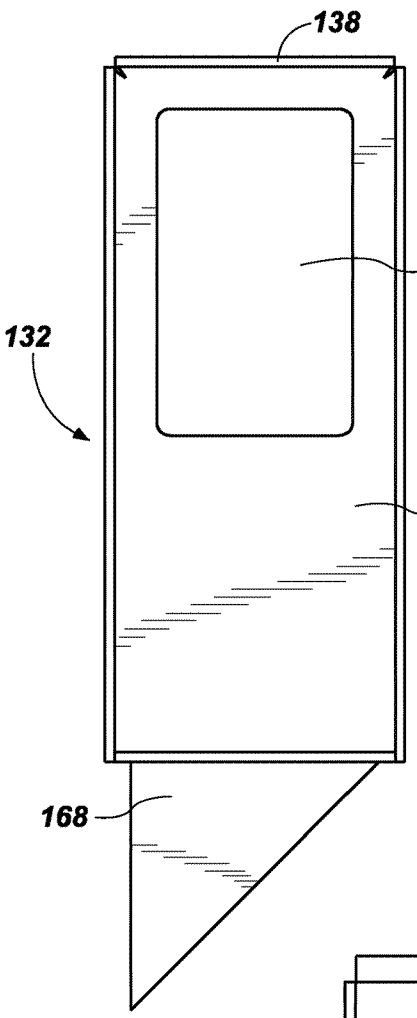
FIG. 28 illustrates a bottom view of the extendable member of FIG. 27.
Figure 29:
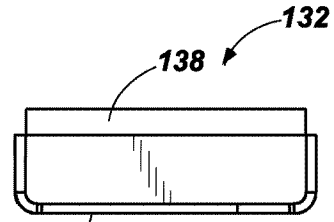
FIG. 29 illustrates a longitudinal side view of the extendable member of FIG. 27.
Figure 31:
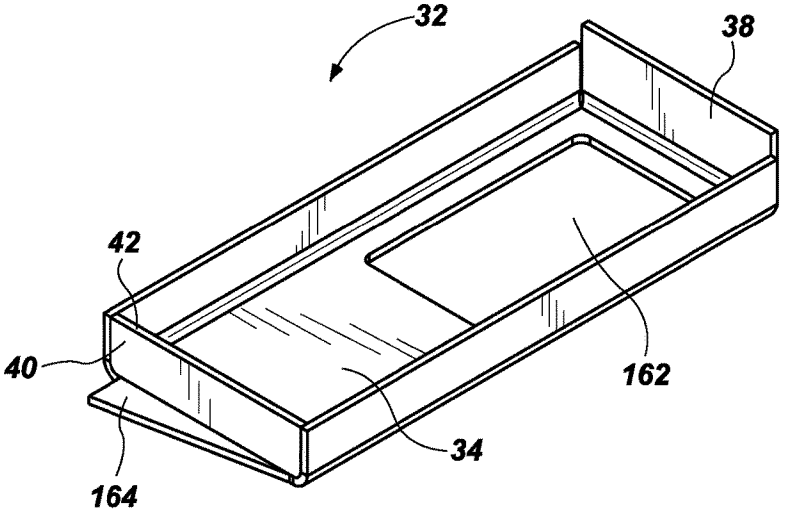
FIG. 31 illustrates a perspective view of an alternate embodiment of an extendable member without slots, but with an angled flange similar to FIG. 19.
Figure 34:
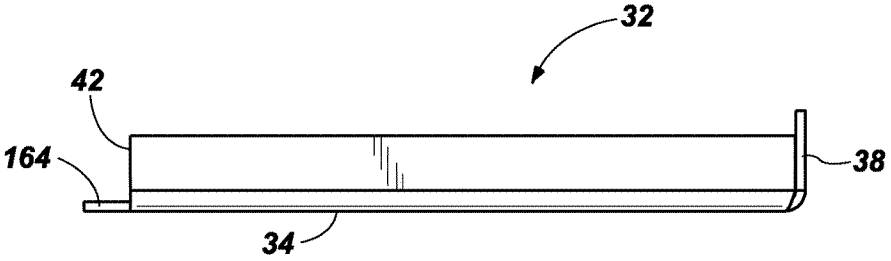
FIG. 34 illustrates a lateral side view of the extendable member of FIG. 31.
Figure 32:
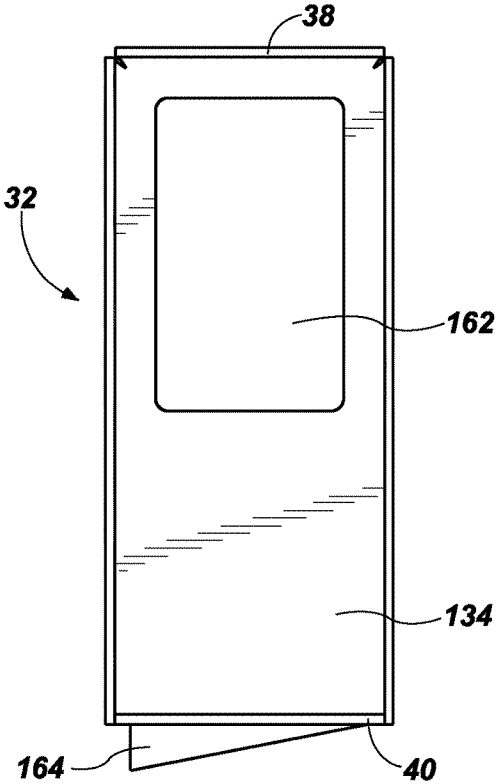
FIG. 32 illustrates a bottom view of the extendable member of FIG. 31.
Figure 33:
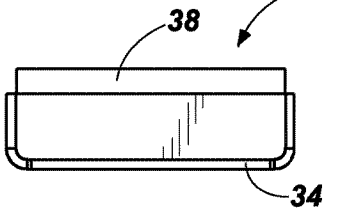
FIG. 33 illustrates a longitudinal side view of the extendable member of FIG. 31.
Figure 35:
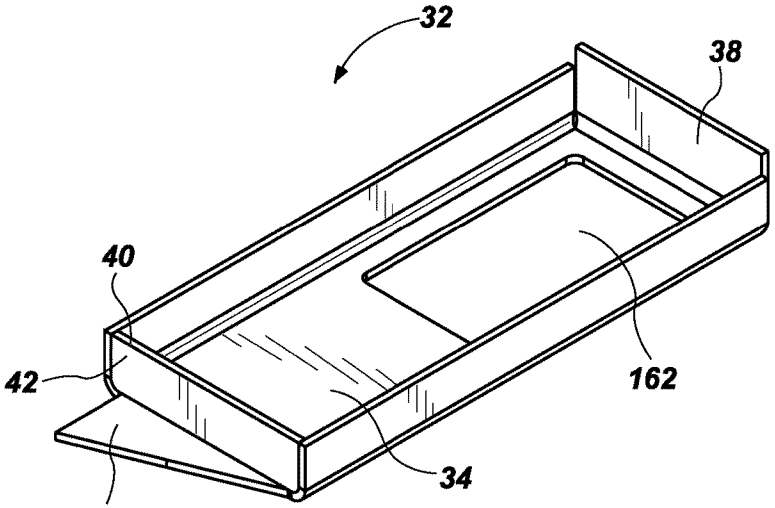
FIG. 35 illustrates a perspective view of an alternate embodiment of an extendable member without slots, but with an angled flange similar to FIG. 23.
Figure 38:
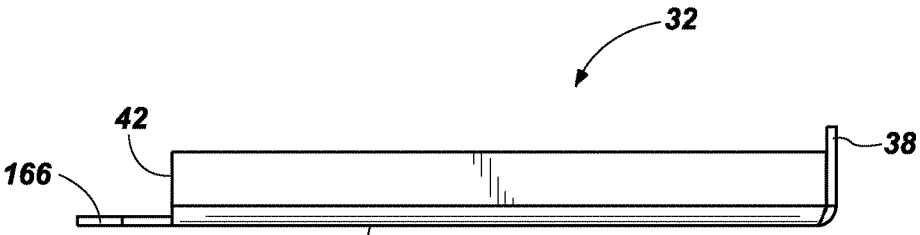
FIG. 38 illustrates a lateral side view of the extendable member of FIG. 35.
Figure 36:
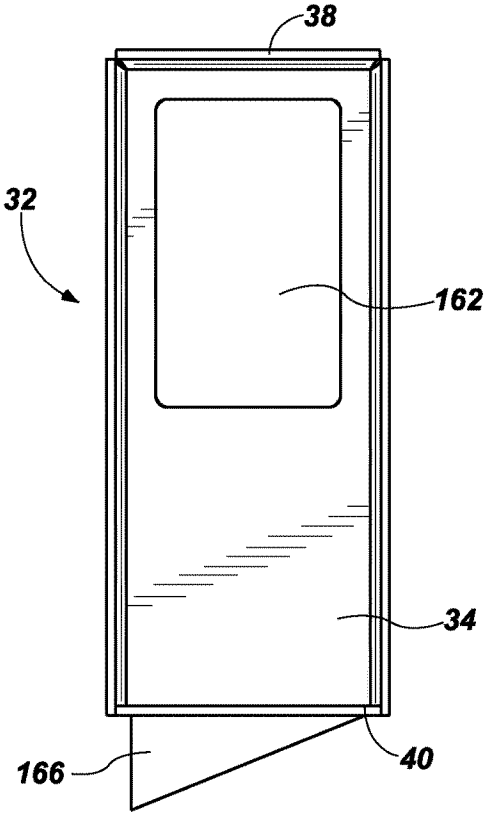
FIG. 36 illustrates a bottom view of the extendable member of FIG. 35.
Figure 37:
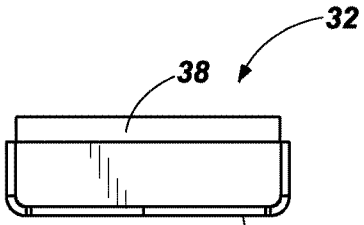
FIG. 37 illustrates a longitudinal side view of the extendable member of FIG. 35.
Figure 39:
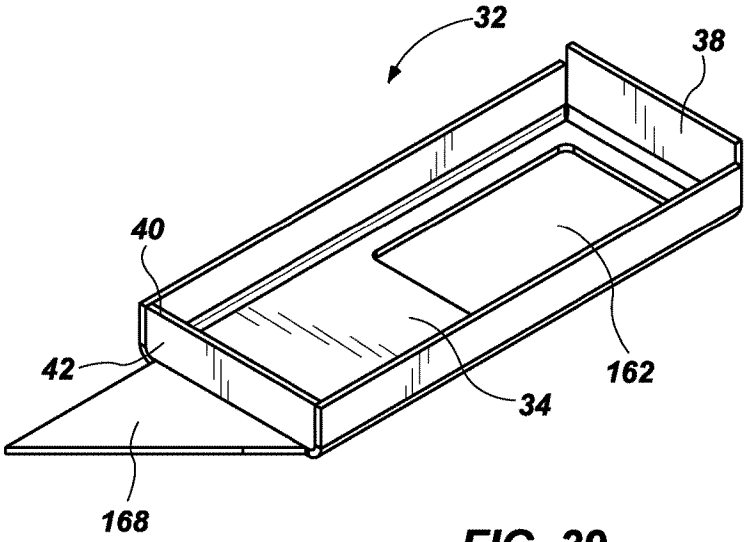
FIG. 39 illustrates a perspective view of an alternate embodiment of an extendable member without slots, but with an angled flange similar to FIG. 27.
Figure 42:
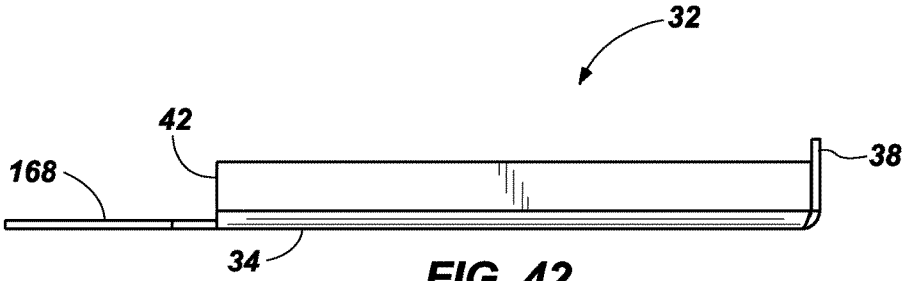
FIG. 42 illustrates a lateral side view of the extendable member of FIG. 39.
Figure 40:
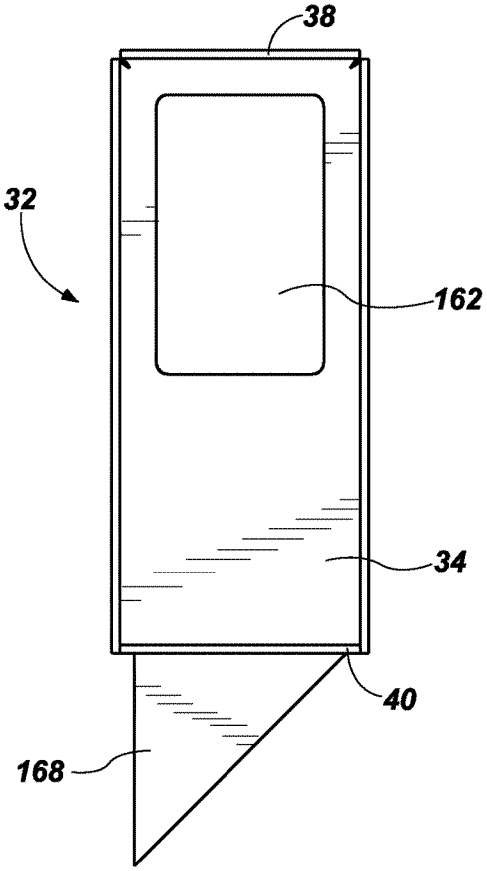
FIG. 40 illustrates a bottom view of the extendable member of FIG. 39.
Figure 41:
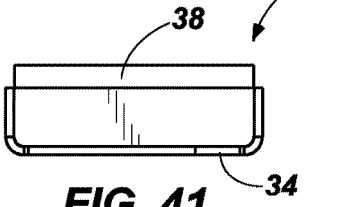
FIG. 41 illustrates a longitudinal side view of the extendable member of FIG. 39.
Figure 43:
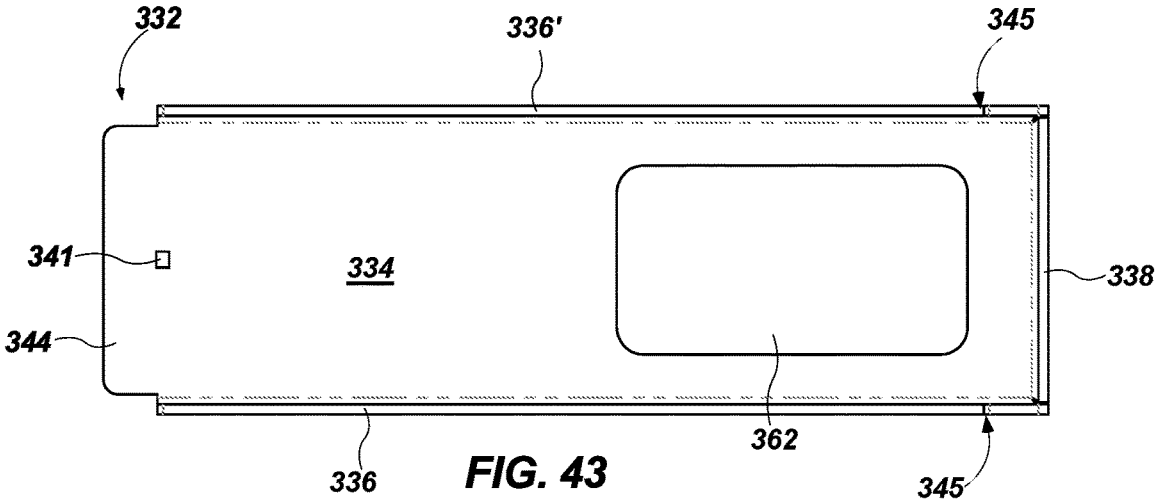
FIG. 43 illustrates a top view of another embodiment of an extendable member according to the present disclosure.
Figure 44:
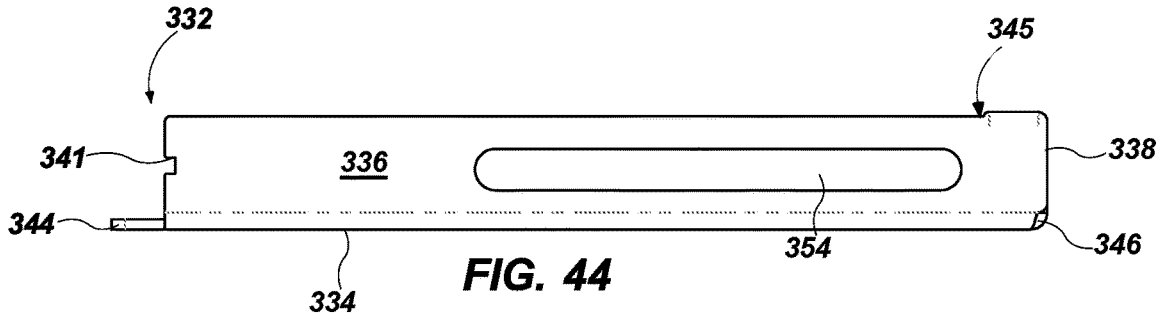
FIG. 44 illustrates a side view of the extendable member of FIG. 43.

Referring to FIG. 10, an alternate embodiment of a system 110 is depicted. The system 110 may include a housing 112 that is substantially similar to the housing 12 previously described herein.

The housing 112 may include a first wall 116, which may be substantially planar, extending a length and a width of the housing 112. The first wall 116 may be substantially flat and configured to allow other flat elements (i.e. bricks, blocks, etc.) to easily reside on the first wall 116. The first wall 16 may include bends or curves toward each width end of the first wall 116. A pair of second walls 118, 118' may extend from the first wall 116, or the bends of the first wall 16, in a direction substantially perpendicular to the first wall 116. Extending from the pair of second walls 118, 118' are a pair of third walls 120, 120' that may extend from separate bends in the second walls 118, 118'. The pair of third walls 120, 120' may extend toward each other and the longitudinal axis 114, or midline, of the longitudinal housing 112. A channel 125 may be positioned between the pair of third walls 120, 120' and run the length of the housing 112. The third walls 120, 120' may be substantially parallel to the first wall 116. The channel 125, passage, or void, may run the length of the housing 112. A cross-sectional shape of the housing 112 may resemble a C-shape or U-shape.

The housing 112 may include a first opening 124 toward one end of the housing 112 and a second opening 126 toward a second end of the housing 112, with the channel 125 running from the first opening 124 to the second opening 126. A cross-bar 128 may extend from the pair of third walls 120, 120' across the channel 125.

Rather than support members 30, this embodiment may include a pin 130, or rod, which may pass through a pair of holes 152 in the housing 112. The pair of holes 152 each pass through the pair of second walls 118, 118', or side walls, as appropriate. The holes 152 may be axially aligned with one another (e.g., aligned on opposing side walls) to allow for easy passage of a pin 130. The pin 130 may at least partially traverse the channel 125. Additionally, and/or alternatively, the pin 130 may traverse the channel 125 entirely.

Similar to the previous extendable members 31, 32 a first extendable member 132 may be substantially rectangular in shape and, from one perspective, may resemble a tray or open top box. The first extendable member 132 includes a body with a planar first wall 134 that may run substantially parallel to the first wall 116 of the housing 112. The first extendable member 132 may also comprise a proximal wall 138 and a distal wall 140, opposite each other, and which may be substantially parallel to each other. Each wall 138, 140 extends from the first planar wall 134 at about a 90° angle and is connected to the pair of extendable member second walls 136, 136'.

The proximal wall 138 may extend further from the planar first wall 134 than the distal wall 140. The proximal wall 138 may extend further than the extendable member second walls 136, 136' as well. That is, the proximal wall 138 may be taller than the distal wall 140 and/or the extendable member second walls 136, 136'. The proximal wall 138 may provide a stop against the pin 130 (as may be seen in FIGS. 11-14) so that the first extendable member 132 does not extend too far out of the housing 112. The distal wall 140 may include a distal tip 142 which may include a flange 144, or tab, which extends longitudinally from the distal wall 140 in the same plane or parallel plane as the planar first wall 134. The distal tip 142 may be integrated into the body of the first extendable member 132 or may be a separate piece that may be secured, or welded, to the distal wall 140. The distal tip 142 may include a right angle piece, or elbow, that on one plane sits flush against the distal wall 140. In a separate plane, perpendicular to the one plane sitting flush against the distal wall 140, the distal tip 142 can extend in a same plane, substantially the same plane, or a parallel plane to the first planar wall 134, which extension may be the flange 144. The flange 144 engages the construction element 50 (see, e.g., FIG. 9).

A second extendable member 131 may be substantially similar and mirror image of the first extendable member 132 with the same elements and features. Each extendable member 132, 131 may extend from the housing 112 at least as far as half of the length of the extendable members 132, 131. Each extendable member 132, 131 may extend just far enough for the flange 144 to protrude from the housing 112 and to engage one edge of an opening (see FIG. 9). Each extendable member 132, 131 may extend as far as required to traverse an opening with the appropriate length of housing 112. The distance each extendable member 132, 131 extends is approximately infinite because each member 132, 131 can slide to any number of positions. For example, each member 132, 131 can slide from the flange 144 abutting the housing 112 and granularly extending until the extendable member 132, 131 is prevented from extending further (e.g., by action of the proximal wall 138 hitting the pin 130).

Extendable member 132, 131 may include slots 154, or cutouts or elongated apertures, within the second walls 136, 136', or side walls. The slots 154 may be elongated holes or apertures extending perpendicular to a plane of the second walls 136, 136'. The slots 154 may be axially aligned with each other and may pass through each of the second walls 136, 136' entirely. The slots 154 may allow for passage and/or movement of the pin 130. The slots 154 may slidably receive the pin 130 so as to allow the elongated members 132, 131 to freely slide into and out of the housing 112. Likewise, the holes 152 may slidably receive the pin 130 and may engage the housing 112 as further described herein. The pin 130 may traverse the holes 152 and the slots 154, and the pin 130 may be secured to the housing 112 with a nut 156 or bolt. Alternatively, the pin 130 may have a transverse aperture that allows for a separate rod to pass through the transverse aperture and secure the pin 130 to the housing. The pin 130 may resemble a screw with threads on at least one end that may engage a nut 156 on one side of the housing, such as on second wall 118, with the head of the screw on the opposite side of the housing, such as on second wall 118'. It will be appreciated that any number of methods and means of securing a rod, pin or screw is contemplated herein.

The slots 154, with the pin 130 passing therethrough, provides a maximum and minimum length of extension for the first extendable member 132. A distal end 158 of the slot 154 may be engaged when the first extendable member 132 is retracted into the housing 112, such as in the first configuration 100. A proximal end 160 of the slot 158 may be engaged when the first extendable member 132 is extended from the housing 112, such as in the second configuration 102, at a maximum distance. The slots 154 may allow for an infinite number of positions between the proximal end of the slot 160 and the distal end of the slot 158.

The first extendable member 132 may further include a window 162, or opening, in the planar wall 134. The window 162 may allow for the first extendable member 132 to be manufactured with less weight for easier use and manipulation. The window 162 may also provide a user with the ability to see through the first extendable member 132 to the traversed opening and the housing 112.

For ease in describing the system 110, the first extendable member 132 may have been utilized and describe, though it will be appreciated that the second extendable member 131 may comprise the same features and elements, and may be a mirror image of the first extendable member 132 when positioned in the housing 112.

Referring to FIGS. 11-18, a system 210 is depicted, where the housing 112 may be the housings 12, 112 as previously described herein. Additionally, the extendable members 31, 32 may be substantially as previously described herein with the addition of the window 162. Rather than the system 10 which comprises support members 30, this system 210 utilizes the same holes 152 and pin 130 from the previous embodiment 110, wherein the pin 130 may act similarly as the support members 30 in maintaining the extendable members 31, 32 in place. as Additionally, the pin 130 engages with the proximal wall 38 to act as a stop, as previously described.

In this embodiment, the pin 130 may provide the same strength and stability as the support members 30 but with far less weight allowing for easier manipulation of the system 110 or system 210.

FIGS. 19-22 illustrate additional views and details of an extendable members, which may be extendable members 31, 32, 131, 132. Though only one extendable member is illustrated, it is to be understood that the other, opposing extendable member is a mirror image, or substantially mirror image, of the illustrated and described extendable member. Referring to FIGS. 19-22, the extendable member 132 may comprise an alternate flange 164 that may comprise an angle. The flange 164 may comprise the same elements as the previously disclosed embodiment of a flange 144. The flange 164 may include an angle of about 11° (e.g., about 9° to about 13°) and may utilize such an angle to allow a user (which may be a mason) to stabilize the system (e.g., a system 10, 110, 210) across an opening, where the opening may have an angled wall or an intersection of two walls that is angled. By providing an angled flange 164, the entire flange 164 can rest on the angled wall with no exposure of the flange 164.

Referring to FIGS. 23-26, the extendable member 132 may comprise an alternate flange 166 that may comprise an angle. A flange 166 may comprise the same elements as the previously disclosed embodiment of a flange 144. The flange 166 may include an angle of about 22° (e.g., about 20° to about 25°) and may utilize such an angle to allow a user (which may be a mason) to stabilize the system across an opening that may have an angled wall or an intersection of two wells that is angled. By providing an angled flange 166 the entire flange me rest on the angled wall with no exposure of the flange 166.

Referring to FIGS. 27-30, the extendable member 132 may comprise an alternate flange 168 that may comprise an angle. A flange 168 may comprise the same elements as the previously disclosed embodiment of a flange 144. The flange 168 may include an angle of about 45° (e.g., about 43° to about 47°) and may utilize such an angle to allow a user (which may be a mason) to stabilize the system across an opening that may have an angled wall or an intersection of two wells that is angled. By providing an angled flange 168 the entire flange me rest on the angled wall with no exposure of the flange 168.

It will be appreciated that any number of angles is contemplated here and specifically between about 5° to 45° and the above examples are simply examples and not limiting herein. For example, the angle may be about 6°, 10°, 15°, 20°, 25°, 30°, 35°, 44°, or an angle within a range defined by any two of the foregoing values.

Referring to FIGS. 31-42 similar examples of angled flanges are provided utilizing the extendable members 32 described in the first embodiment of the system 10 with the exception of the window 162 also contemplated herein. Similar angles to the previous embodiments are shown with angles of 11°, 22° and 45° respectively. These embodiments may not include the slots 154 as these embodiments may be intended for use with the alternate system 210 but may also be utilized in the first described system 10.

The dimensions of the system may vary as well. The housing 12, 112 may be anywhere from 2 feet (or roughly 0.6 meters) to 42 feet (or roughly 13 meters) in length. The width of the housing 12 may be 4 to 8 inches (or roughly 10 cm to 21 cm). The height of the housing 12 may be 2 to 4 inches (or roughly 5 cm to 11 cm). The length of the extendable members 31, 32, may vary but may be in the range of 12 to 18 inches (or roughly 30 cm to 46 cm), with the extendable members 31, 32 being capable of extending 6 to 9 inches (or roughly 15 cm to 23 cm).

A user may then use building materials, bricks, blocks, etc., to build across and on top of the system 10, utilizing the system 10 to stabilize the building materials. The user may then remove the system 10 by simply retracting the extendable members 31, 32 into the housing 12 at least enough to release the flange(s) from the edges of the construction element 50 opening.

It will be appreciated that the housing 12, 112, or shell, may be comprised of 12-14 Gauge C Channel purlin which is a commonly used beam to extend over a roof or other constructive element. The extendable members 31, 32, 131, 132 (or trays) may be one-quarter inch milled steel (it may also be cast, forged, extruded, welded, etc.). The pin 130, or rod, may be comprised of steel, other metal or metal alloys that provide the strength and rigidity necessary for the functions described herein. Other metals and materials may be used with a similar construct and even wood, plastics and carbon-fiber are contemplated.

FIGS. 43-46 illustrate another embodiment of a first extendable member 332 according to the present disclosure. As before, though only one extendable member 332 is illustrated, it is to be understood that the other, opposing extendable member 331 is a mirror image, or substantially mirror image, of the illustrated and described extendable member 332. Similar to the previous extendable members 31, 32 a first extendable member 332 may be substantially rectangular in shape and, from one perspective, may resemble a tray or open top box. The first extendable member 332 includes a body with a planar first wall 334 that may run substantially parallel to the first wall 316 of the housing 312 (see FIGS. 52-59). The first extendable member 332 may also comprise a proximal wall 338 and a distal wall 340, opposite each other, and which may be substantially parallel to each other. Each wall 338, 340 extends from the first planar wall 334 at about a 90° angle and is connected to the pair of extendable member second walls 336, 336'.

In some embodiments, the proximal wall 338 may extend further from the planar first wall 334 than the distal wall 340. In some embodiments, the proximal wall 338 may extend further than the extendable member second walls 336, 336' as well. That is, the proximal wall 338 may be taller than the distal wall 340 and/or the extendable member second walls 136, 136'. The proximal wall 338 may provide a stop against the pin 330 (as may be seen in FIGS. 11-14 and 59) so that the first extendable member 332 does not extend too far out of the housing 312. The distal wall 340 may include a distal tip 342 which may include a flange 344, or tab, which extends longitudinally from the distal wall 340 in the same plane or parallel plane as the planar first wall 334. Alternatively, the flange 344 may be continuous with the planar first wall 334.

Figure 47:
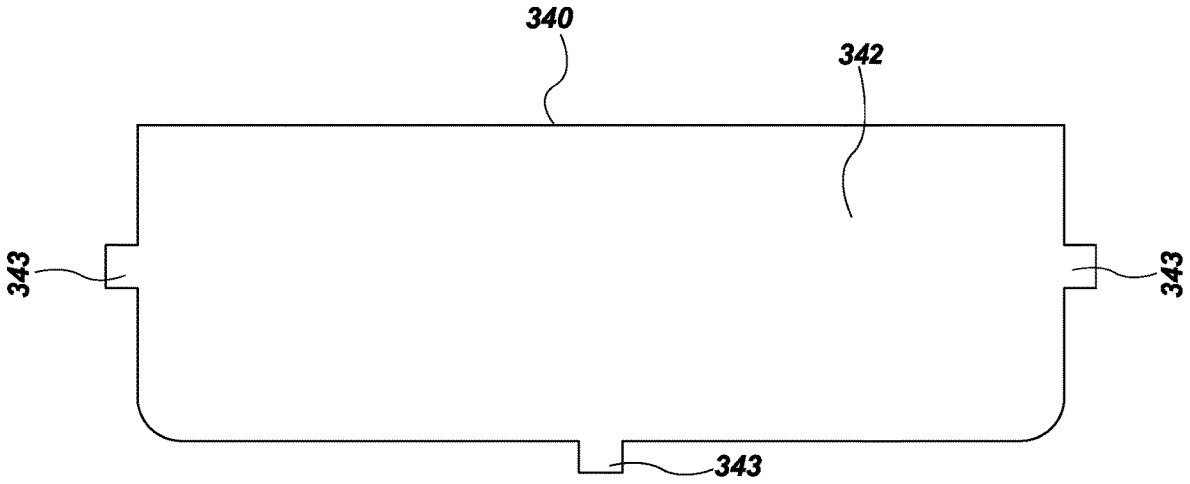
FIG. 47 illustrates a plan view and FIG. 48 illustrates a side view of another embodiment of a distal tip for an extendable member according to the present disclosure.
Figure 48:
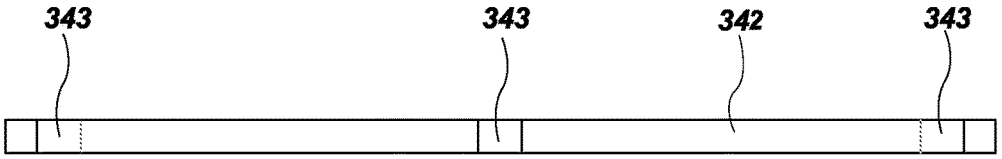

The distal tip 342 may be integrated into the body of the first extendable member 332 or may be a separate piece that may be secured, or welded, to the distal wall 340. For example, referring to FIGS. 47-48, the distal tip 342 may include a plurality of tabs 343 that may removably mate with or engage a plurality of corresponding notches or holes 341 in the extendable member 332. The distal tip 342 may include a right-angle piece, or elbow, that on one plane sits flush against the distal wall 340. In a separate plane, perpendicular to the one plane sitting flush against the distal wall 340, the distal tip 342 can extend in a same plane, substantially the same plane, or a parallel plane to the first planar wall 334, which extension may be the flange 344. The flange 344 engages the construction element 50 (see, e.g., FIG. 9).

Figure 49:
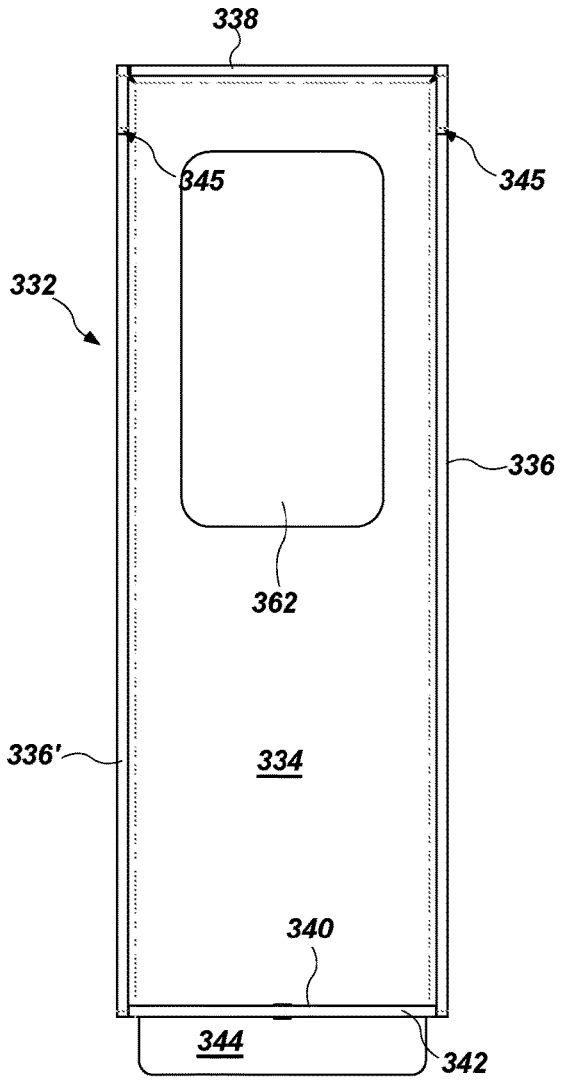
FIG. 49 illustrates a top view of the extendable member of FIG. 43 including the distal tip of FIGS. 47 and 48.
Figure 50:
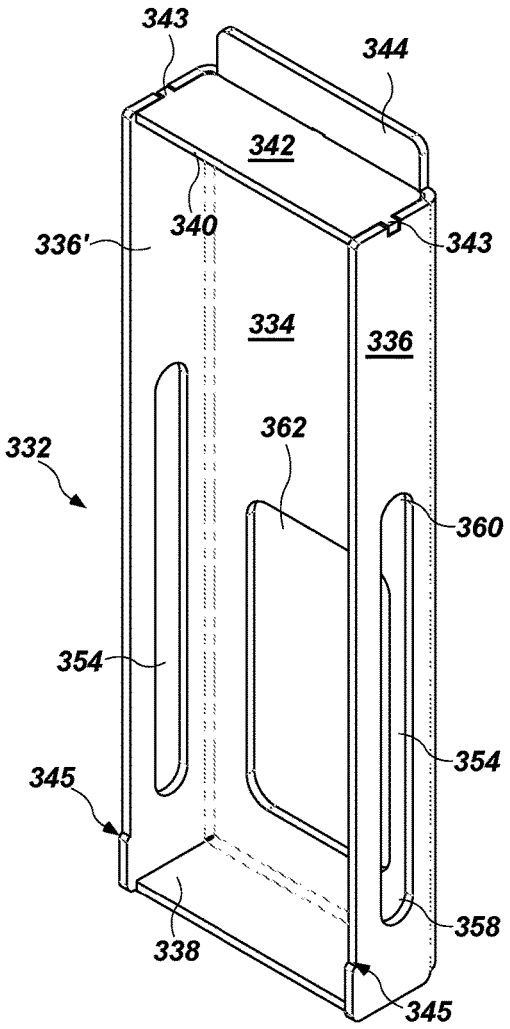
FIG. 50 illustrates a perspective view and FIG. 51 illustrates a side view of the extendable member of FIG. 49.
Figure 51:
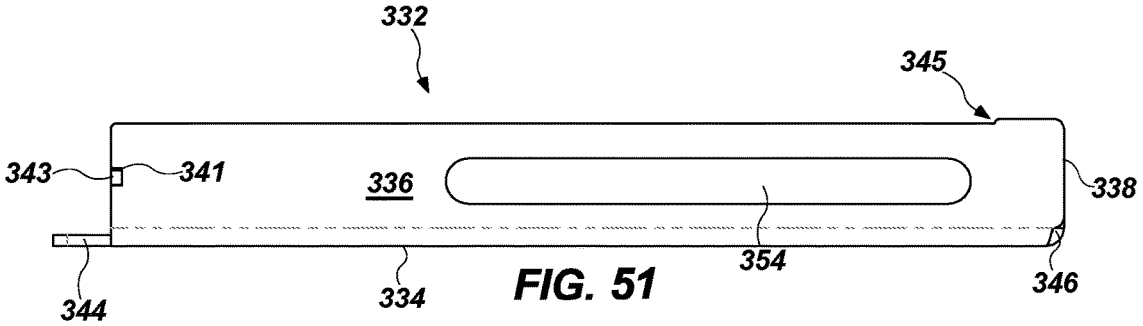

As illustrated in FIGS. 49-51, the distal tip 342 is received by the extendable member 332 at the distal wall 340, where the distal tip 342 may also be the distal wall 340. The tabs 343 of the distal tip 342 are received by holes 341 located at the distal end of the extendable member 332. When mated with the holes 341, the distal tip 342 may be substantially flush with the walls 336, 336' of the extendable member 332.

A second extendable member 331 may be substantially similar and a mirror image of the first extendable member 332 with the same elements and features. Each extendable member 332, 331 may extend from the housing 312 at least as far as half of the length of the extendable members 332, 331. Each extendable member 332, 331 may extend just far enough for the flange 344 to protrude from the housing 312 and to engage one edge of an opening (see FIG. 9). Each extendable member 332, 331 may extend as far as required to traverse an opening with the appropriate length of housing 312. The distance each extendable member 332, 331 extends is approximately infinite because each member 332, 331 can slide to any number of positions. For example, each member 332, 331 can slide from the flange 344 abutting the housing 312 and granularly extending until the extendable member 332, 331 is prevented from extending further (e.g., by action of the proximal wall 338 hitting the pin 330).

Extendable member 332, 331 may include raised notches 345 within the second walls 336, 336', or side walls. The notches 345 may be positioned closer to the proximal wall 338 of the extendable members 332, 331. The raised notches 345 enhance the clearance and level attitude of the extendable member 332, 331 when fully extended from the housing 312. Further, the raised notches 345 allow a system 310 of the housing 312 and extendable members 332, 331 (see FIG. 59) to be installed and maintain a more level setting surface while traversing an opening in a structure (see FIG. 9). Additionally, the raised notches 345 allow systems 310 to be effectively linked together to cross virtually any width opening. Still further, systems 310 can be mixed and matched to be utilized together in an infinite number of sizes based on the field requirement.

Extendable member 332, 331 may include slots 354, or cutouts or elongated apertures, within the second walls 336, 336', or side walls. The slots 354 may be elongated holes or apertures extending perpendicular to a plane of the second walls 336, 336'. The slots 354 may be axially aligned with each other and may pass through each of the second walls 336, 336' entirely. The slots 354 may allow for passage and/or movement of a pin 330. In some embodiments, the pin 330 may include two (2) pins 330, each received by a hole 352, or housing hole, in the housing 312, discussed more fully below with respect to FIG. 52. The slots 354 may each slidably receive the pins 330 so as to allow the elongated members 332, 331 to freely slide into and out of the housing 312.

Likewise, the holes 352 may slidably receive the pins 330 and may engage the housing 312 as further described herein. The pin 330 may traverse the holes 352 and the slots 354, and the pin 330 may be secured to the housing 312 with a nut 356 or bolt. The pin 330 may resemble a screw with threads on at least one end that may engage a nut 356 on one side of the housing, such as on second wall 318, with the head of the screw on the opposite side of the housing, such as on second wall 318'. It will be appreciated that any number of methods and means of securing a rod, pin or screw is contemplated herein.

Alternatively, in some embodiments, the pins 330 may resemble rivet nuts (also referred to as "rivnuts") and the holes 352 of the housing 312 may be ports to receive the rivnuts. The holes 352 may be positioned in or around the four (4) corners of the housing 312, allowing the extendable members 332, 331 to be directly attached or secured to the inside of the housing 312. Such an arrangement allows the extendable members 332, 331 to be secured and attached to the housing 312 with reduced drag or friction. Additionally, the arrangement allows the extendable members 332, 331 to be fully retracted into the housing 312 at both ends of the housing 312, which allows for the connection of multiple housings 312 together to span and cross any width or opening.

For example, an eight-foot housing 312 can be combined with a twelve-foot housing 312 to cross a twenty-foot opening. Any other combinations tailored to specific sized openings are also considered by the present disclosure. This also allows multiple sized housings 312 to be combined "on the fly," such as when changes in the field necessitates an opening size not anticipated in the original plan specifications.

Inclusion of the pins 330 (e.g., rivnuts) also simplifies service or repair of a system 310 incorporating the housing 312, the pins 330, and the extendable member 332, 331. Specifically, the pins 330 received by the holes 352 can easily be ground down/off with any handheld grinder, allowing the extendable member 332, 331 to be removed and quickly replaced. As damage to the extendable member 332, 331 is the most common form of damage for disclosed systems 310, quick and efficient removal and replacement enhances the overall longevity of the disclosed systems 310.

As discussed more fully below, inclusion of the pins 330 (e.g., rivnuts) allows multiple systems 310 to be quickly and efficiently connected together utilizing a coupler 322 (see FIGS. 63-67). Specifically, the coupler 322 simply and quickly connects any two housings 312 by bolting the coupler 322 into four holes 352 disposed, or positioned, about the corners of the housing 312—two holes 352, axially aligned, on a first housing 312 and two holes 352, axially aligned, on a second housing 312, where the ends of the housings 312 abut each other within the coupler 322. Connection of multiple housings 312 can be accomplished in a short time period, or time frame, een within minutes (e.g., 1, 5, 10, 15, 30 minutes etc.) rather than the hours typically associated with other steel fabricated or wood shoring systems.

The slots 354 provide a maximum and minimum length of extension for the first extendable member 332. A distal end 358 of the slot 354 may be engaged when the first extendable member 332 is retracted into the housing 312, such as in the first configuration 100. A proximal end 360 of the slot 354 may be engaged when the first extendable member 332 is extended from the housing 312, such as in the second configuration 102, at a maximum distance. The slots 354 may allow for an infinite number of positions between the proximal end of the slot 360 and the distal end of the slot 358.

The first extendable member 332 may further include a window 362, or opening, in the planar wall 334. The window 362 may allow for the first extendable member 332 to be manufactured with less weight for easier use and manipulation. The window 362 may also provide a user with the ability to see through the first extendable member 332 to the traversed opening and the housing 312.

For ease in describing the system 310, the first extendable member 332 may have been utilized and describe, though it will be appreciated that the second extendable member 331 may comprise the same features and elements, and may be a mirror image of the first extendable member 332 when positioned in the housing 312.

FIGS. 52-58 illustrate another embodiment of a housing 312 according to the present disclosure. The housing 312 may include a first wall 316, which may be substantially planar, extending a length and a width of the housing 312. The first wall 316 may be substantially flat and configured to allow other flat elements (i.e. bricks, blocks, etc.) to easily reside on the first wall 316. The first wall 316 may include bends or curves toward each width end of the first wall 316. A pair of second walls 318, 318' may extend from the first wall 316, or the bends of the first wall 316, in a direction substantially perpendicular to the first wall 316. Extending from the pair of second walls 318, 318' are a pair of third walls 320, 320' that may extend from separate bends in the second walls 318, 318'. The pair of third walls 320, 320' may extend toward each other and a longitudinal axis 314, or midline, of the longitudinal housing 312. A channel 325 may be positioned between the pair of third walls 320, 320' and run the length of the housing 312. The third walls 320, 320' may be substantially parallel to the first wall 316. The channel 325, passage, or void, may run the length of the housing 312. A cross-sectional shape of the housing 312 may resemble a C-shape or U-shape.

The housing 312 may include a first opening 324 toward one end of the housing 312 and a second opening 326 toward a second end of the housing 312, with the channel 325 running from the first opening 324 to the second opening 326. A plurality of cross-bars 328 may extend from the pair of third walls 320, 320' across the channel 325.

As discussed, this embodiment may include pins 330 which may pass through a pair of holes 352 in the housing 312. The pair of holes 352 each pass through the pair of second walls 318, 318', or side walls, as appropriate. The holes 352 may be axially aligned with one another (e.g., aligned on opposing side walls) to allow for easy passage of the pins 330. The pins 330 may at least partially extend into the channel 325, where the pins 330 will engage with the slots 354 of the extendable member 332, 331.

Figure 45:
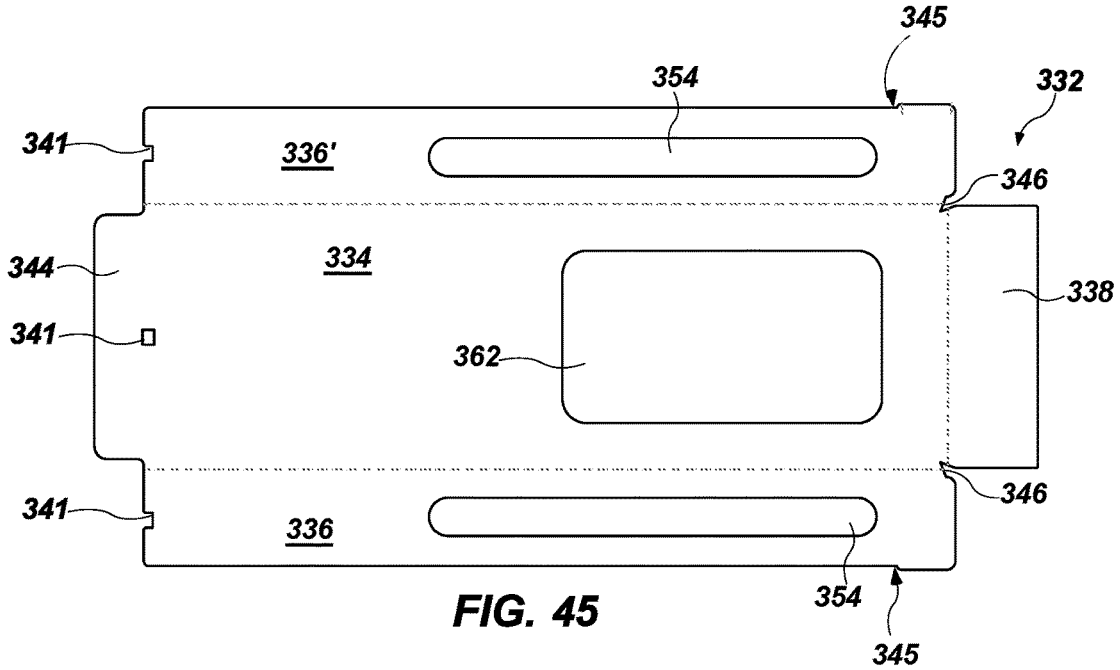
FIG. 45 illustrates a top, unfolded view of the extendable member of FIG. 43.
Figure 46:
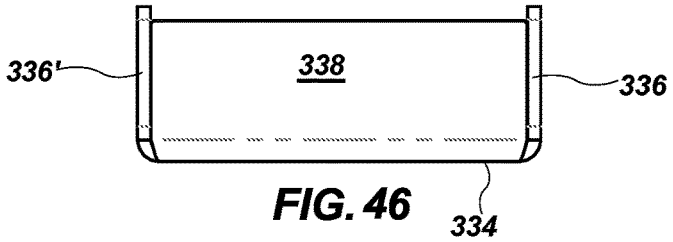
FIG. 46 illustrates an end view of the extendable member of FIG. 43.
Figure 52:
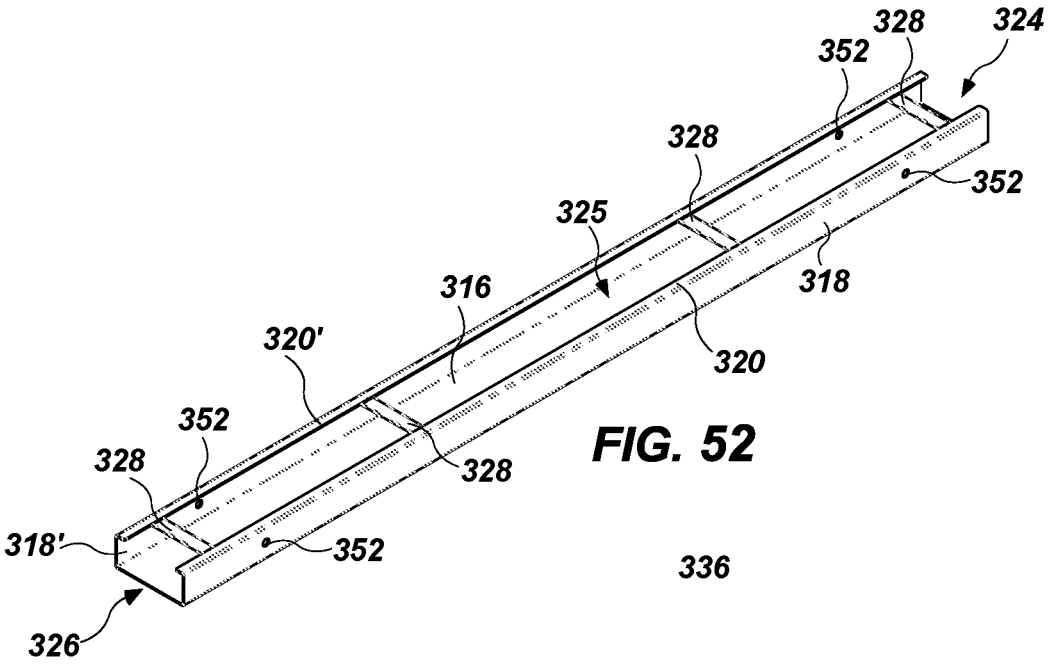
FIG. 52 illustrates a perspective view of another embodiment of a housing according to the present disclosure.
Figure 53:
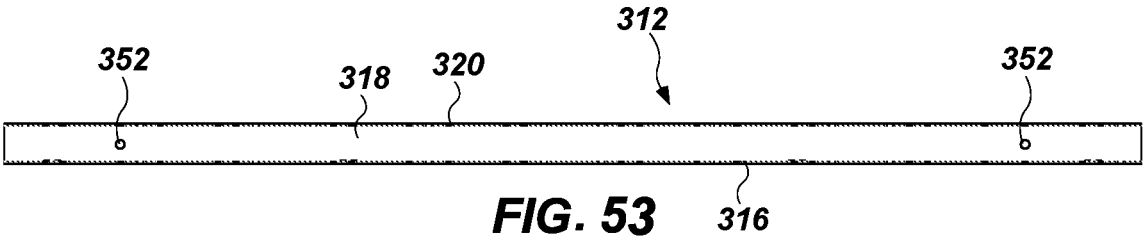
FIG. 53 illustrates a side view and FIG. 54 illustrates a top view of the housing of FIG. 52.
Figure 54:
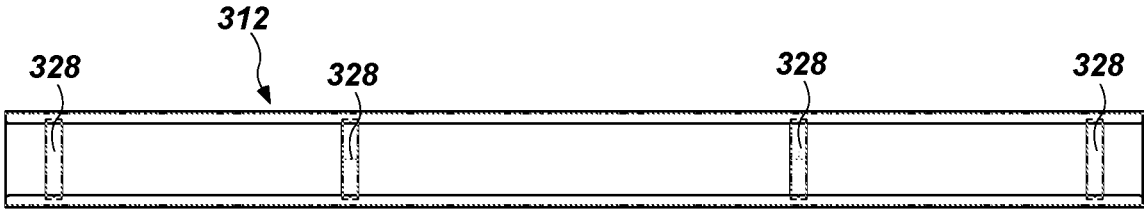
Figure 55:
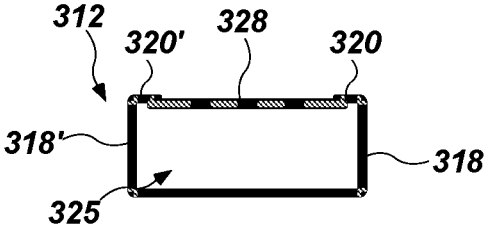
FIG. 55 illustrates an end view of the housing of FIG. 52.
Figure 56:
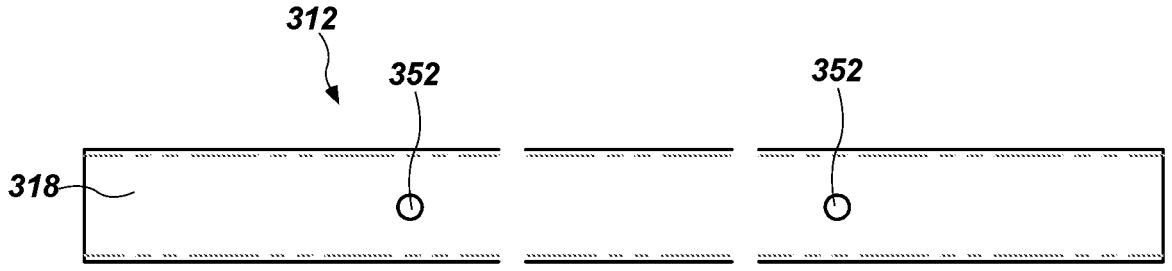
FIG. 56 illustrates another side view of the housing of FIG. 52.
Figure 57:
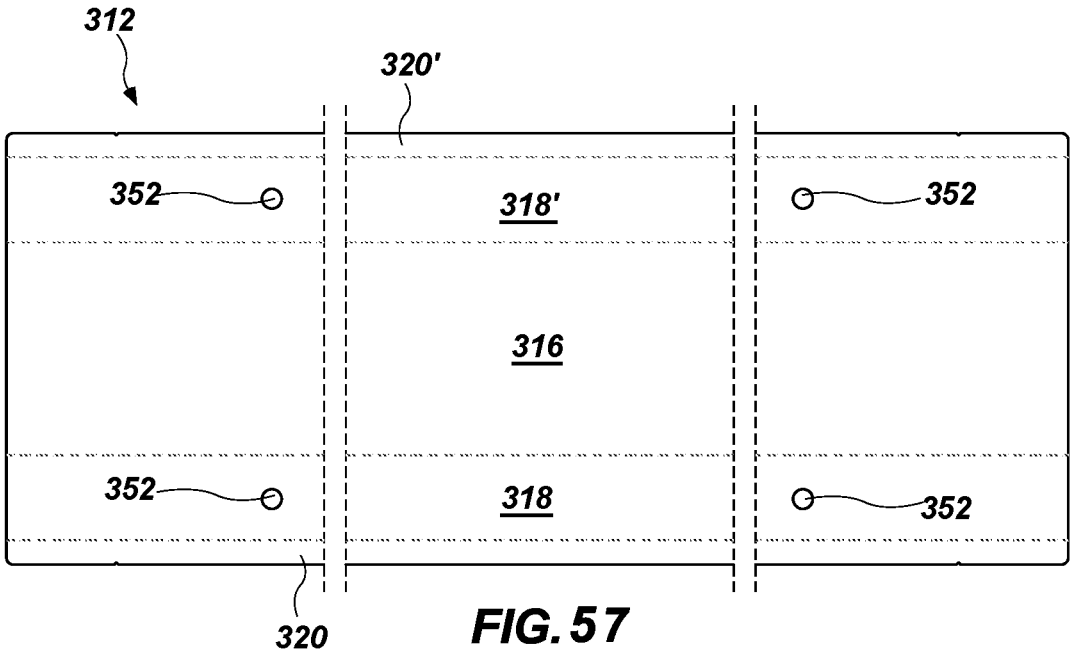
FIG. 57 illustrates a top, unfolded view of the housing of FIG. 52.
Figure 58:
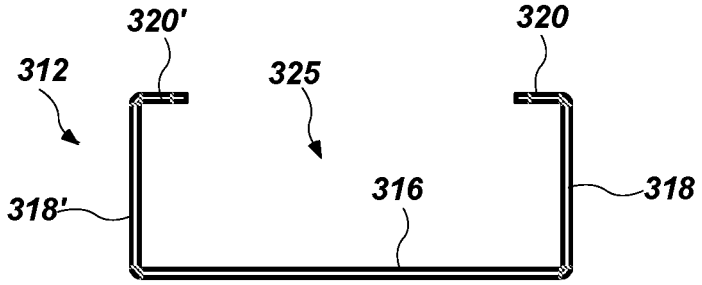
FIG. 58 illustrates an end view of the housing of FIG. 52.
Figure 59:
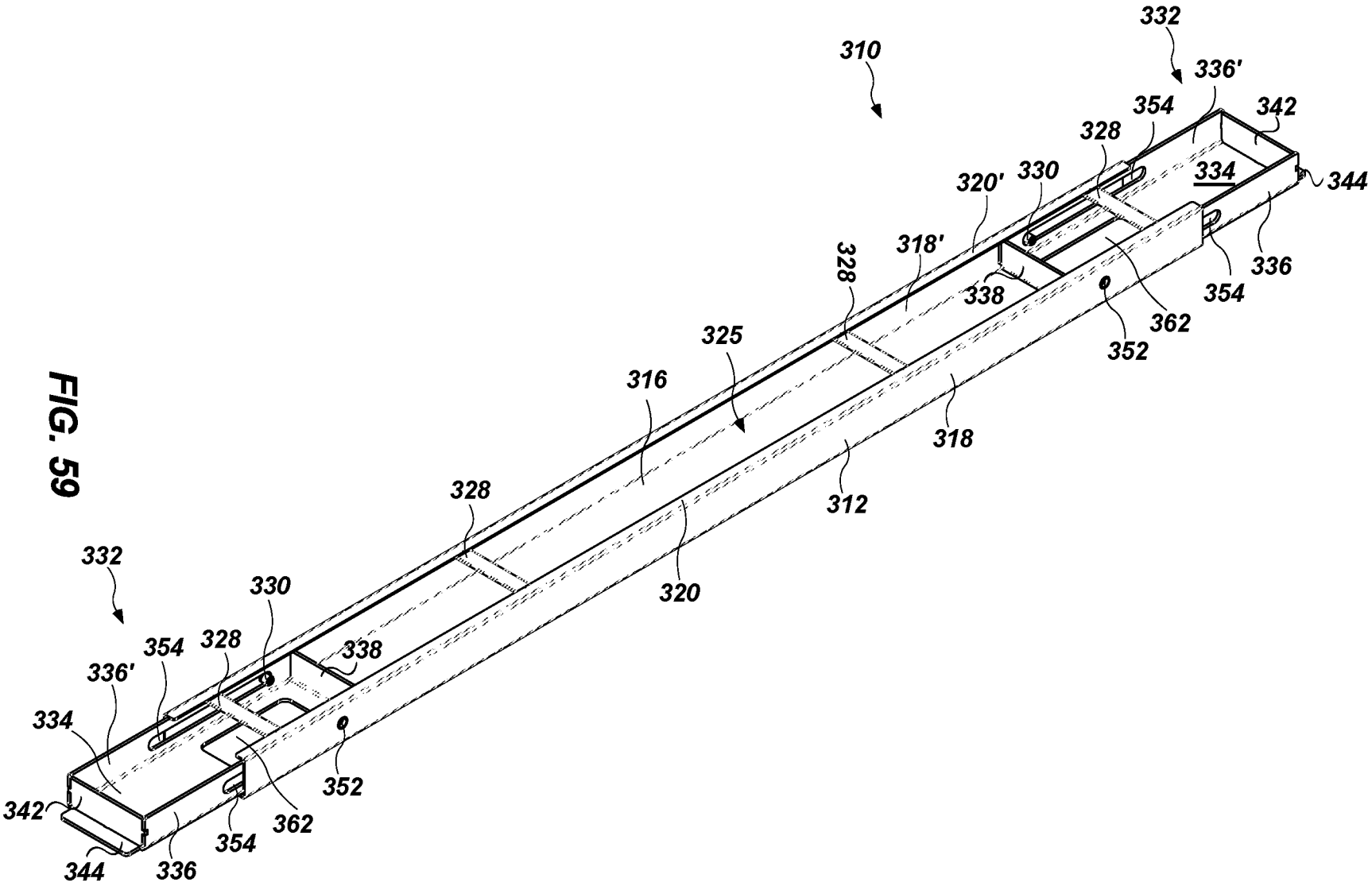
FIG. 59 illustrates another embodiment of a system in a second configuration with the housing of FIG. 52 and two extendable members of FIG. 45 partially extended from the housing.
Figure 60:
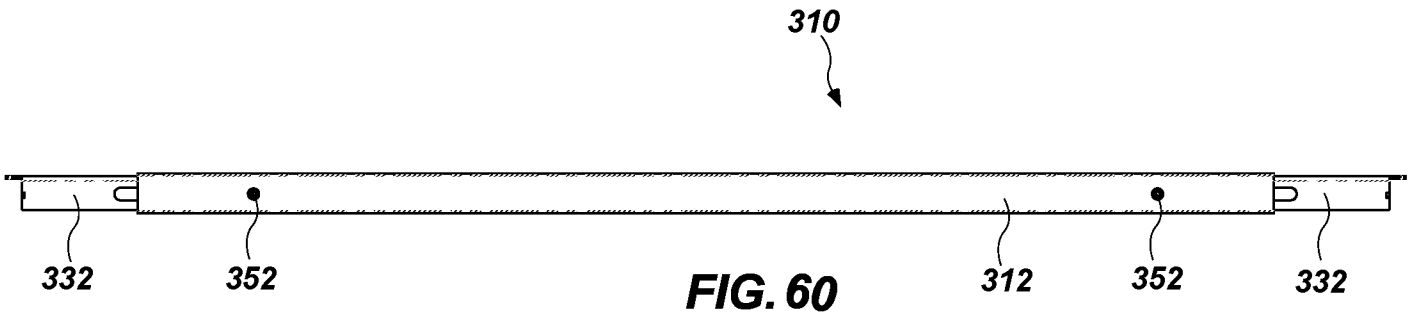
FIG. 60 illustrates a side view and FIG. 61 illustrates a top view of the system of FIG. 56.
Figure 61:
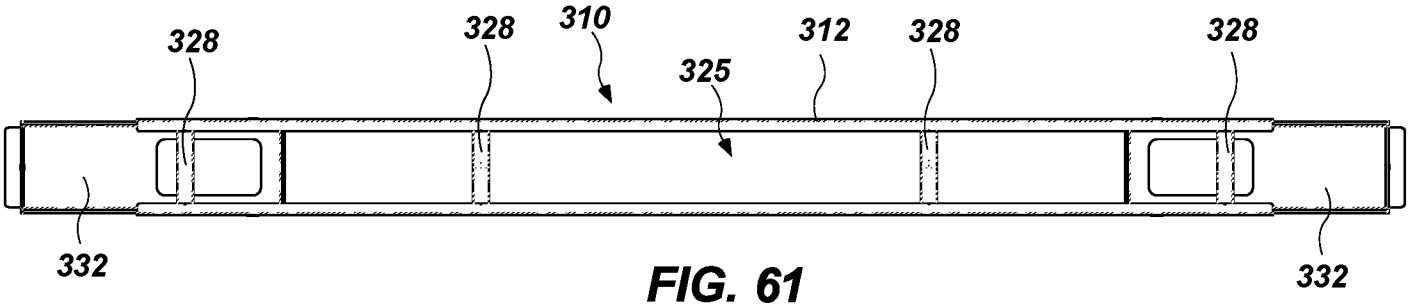
Figure 62:
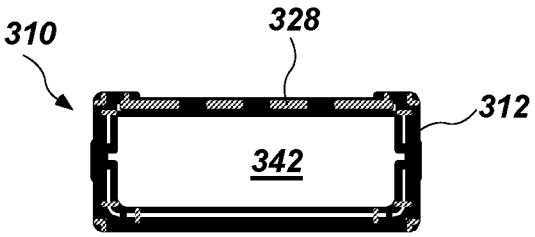
FIG. 62 illustrates an end view of the system of FIG. 59.

FIGS. 59-62 illustrate another embodiment of a system 310 in a second configuration with the housing of FIG. 52 and two extendable members of FIG. 45 partially extended from the housing 312. As before, the pins 330 maintain the position of the extendable member 332, 331 within the channel 325 of the housing 325 while allowing the extendable member 332, 331 to slide within the channel 325. Specifically, the extendable member 332, 331 slides between a first configuration, where the extendable member 332, 331 is retracted within the channel 325, to a second configuration, where the extendable member 332, 331 is extended a distance from the channel 325. When the pins 330 engage the distal end 358 of the slots 354 (see FIG. 50), the extendable member 332, 331 is "fully extended" from the channel 325. When the pins 330 engage the proximal end 360 of the slots 354 (see FIG. 50), the extendable member 332, 331 is "fully retracted" within the channel 325. In some embodiments, the distal tip 342 of the extendable member 332, 331 is substantially flush with an end of the housing 312 and only the flange 344 extends from the housing 312.

The extendable members 332, 331 may extend from a fraction of one inch (e.g., ¼, ½, ⅓ inch) to up to 12 inches from the housing 312. The length of the entire system 310 may vary from 1.5 feet (18 inches) up to 42 feet and perhaps even longer. The housing 312 may be the majority of the length of the system 310 while the extendable members 332, 331 remain roughly the same size, regardless of the housing 312 size. However, it is contemplated that the extendable members size or length 332, 331 may increase proportionately to the housing 312 size.

Depending on the length of the system 310 utilized, for the system 310 to traverse an opening in a construction element 50, posts, post shores, or props may be required to engage the system 310 at one or more locations. The posts may engage the system 310 on a bottom side, or within the channel 325 side of the housing 312 at strategic locations in the opening of the construction element 50. As discussed below, posts, or support beams, may engage a coupler 322 via holes 337, or coupler holes, in a first wall 327 of the coupler 322. The first wall 327 may comprise an inner channel surface 364 and an outer planar surface 366.

Figure 63:
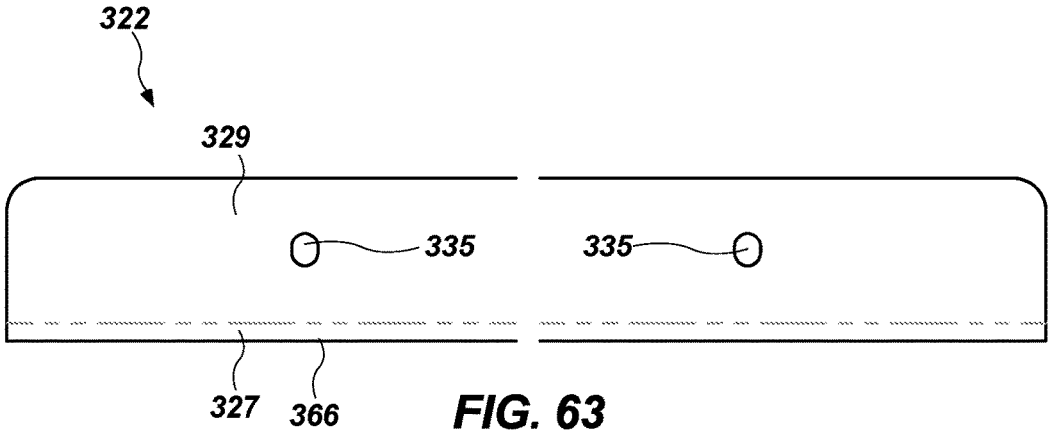
FIG. 63 illustrates one embodiment of a coupler according to the present disclosure.
Figure 64:
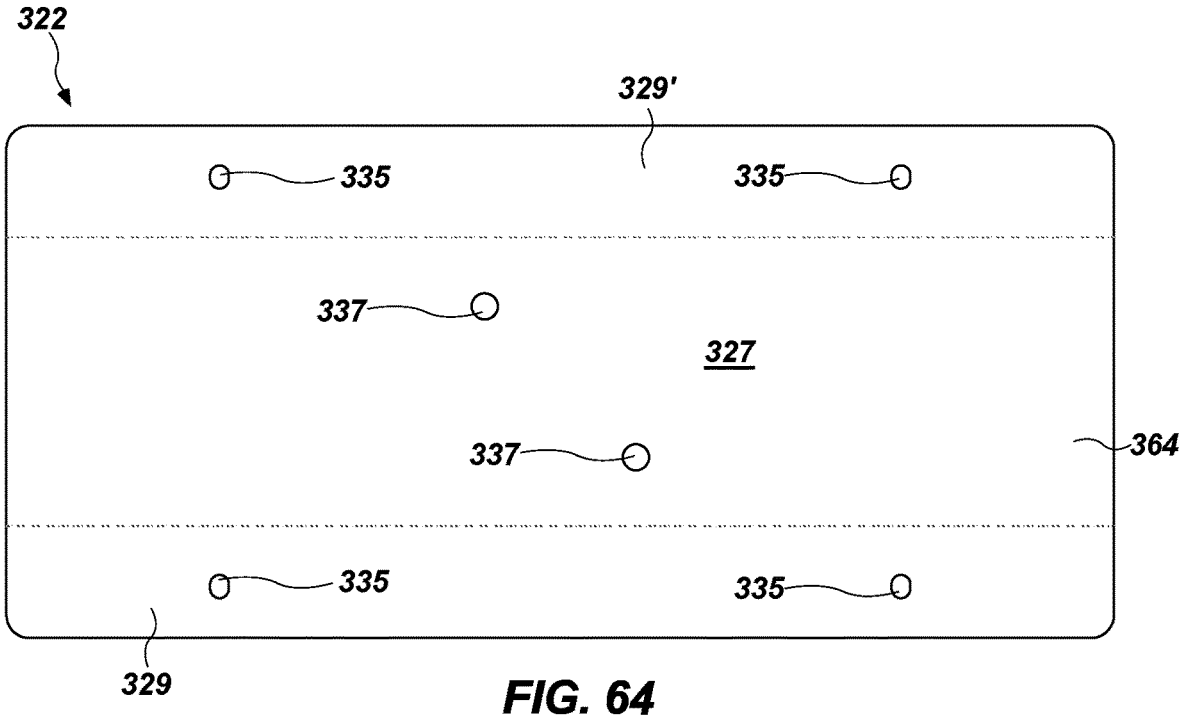
FIG. 64 illustrates a top, unfolded view of the coupler of FIG. 63.
Figure 65:
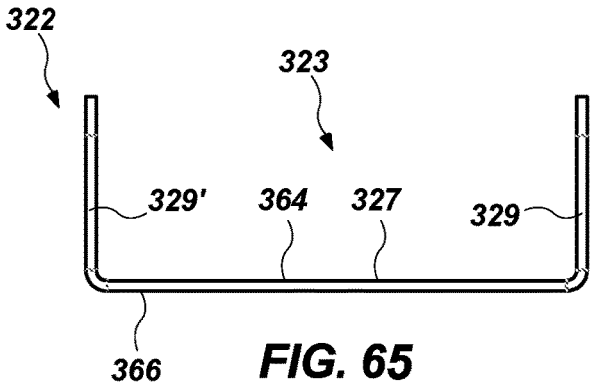
FIG. 65 illustrates an end view of the coupler of FIG. 63.

FIGS. 63-65 illustrate one embodiment of a coupler 322 according to the present disclosure. As illustrated, the coupler 322 includes a first wall 327, which may be substantially planar, extending a length and a width of the coupler 322. The first wall 327 may be substantially flat and configured to allow other flat elements (i.e., housings 312) to easily reside on the first wall 327. A pair of second walls 329, 329' may extend from the first wall 327 in a direction non-parallel, or substantially perpendicular, to the first wall 327. The first wall 327 together with the second walls 329, 329' define a channel 323, or coupler channel. A pair of holes or ports 335, or coupler ports, are defined in each second wall 329, 329'. A pair of coupler holes 337 are defined in the first wall 327. The pairs of coupler ports 335 may be axially aligned with each other and may be disposed within the walls 329, 329' such that they are also axially aligned with housing holes 352 on one end of the housing 312. Such alignment of the pairs of ports 335 and housing holes 352 allows the coupler 322 to be bolted or otherwise secured to one end of the housing 312. For example, the pairs of ports 335 and the housing holes 352 may receive rivnuts that secure the coupler 322 to one end of the housing 312.

The disposition of the coupler ports 335 around the coupler 322 allows the coupler 322 to be aligned with the housing holes 352 of two housings 312. That is, a first housing 312 can be aligned and secured to the coupler 322 via alignment of the housing holes 352 and the coupler ports 335. A second housing can be similarly aligned and secured to the coupler 322, where the second housing 312 will abut the first housing 312 within the coupler 322. As shown in FIG. 65, the coupler 322 may have a C-shaped or U-shaped cross-section to receive the housings 312.

Figure 66:
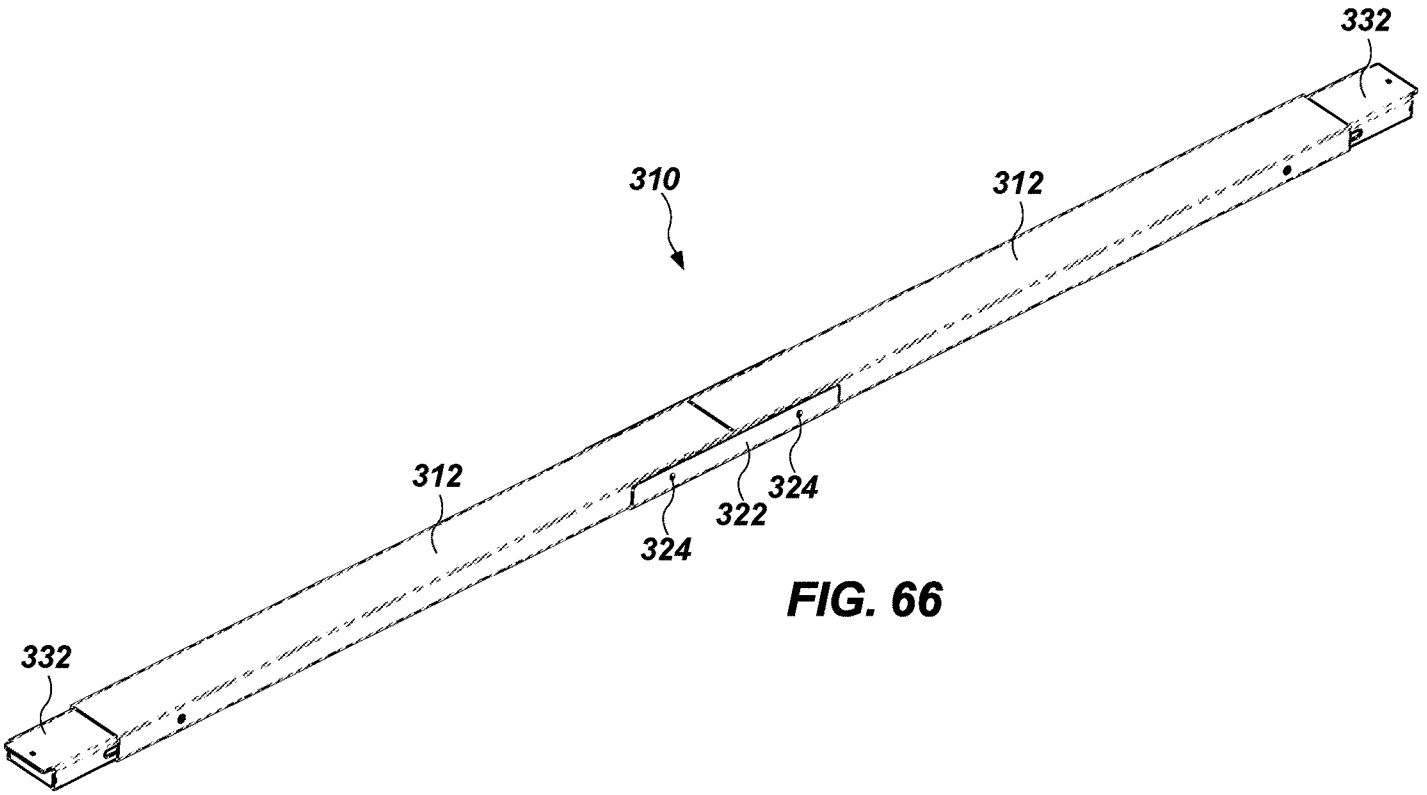
FIG. 66 illustrates another embodiment of a system including two housings of FIG. 51 each having the extendable member of FIG. 45 joined together by the coupler of FIG. 63.
Figure 67:
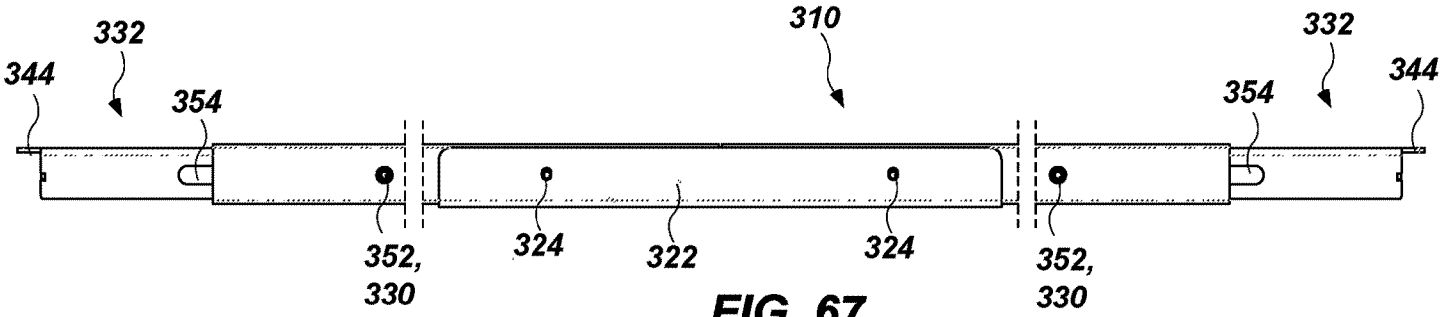
FIG. 67 illustrates a side view of the system of FIG. 66.

FIGS. 66-67 illustrate another embodiment, or use, of a system 310 including two housings 312 joined together by the coupler 322. The housings 312 are received within the channel 323 of the coupler 322. Additionally, the housings 312 oriented such that the channel 325 faces the coupler channel 323 and such that when the system 310 is in position the outer planar surface 366, of the coupler 322, faces down, or substantially downward, such that a support beams, or posts, may engage the coupler holes 337 from the outer planar surface 366. The ports 335 of the coupler 322 align with housing holes 352 of each housing 312 to secure the housings 312 to the coupler 322. Due to the orientation of the housing holes 352 and ports 335, the housings 312 can be quickly and simply joined together via the coupler 322. The housings 312 abut each other at a substantial mid-point or center of the coupler 322. The coupler 322 is sized and shaped to receive any length of housing 312. The coupler holes 337 defined in the first wall 327 of the coupler 322 may be for receiving a post or other support structure as the system 310 traverses an opening of a structure.

Alternatively, the coupler 322 may be positioned such that the coupler channel 323 receives the housings 312 first planar wall 334 (as one example) against the inner channel surface 364. The inner channel 364, may face downward, or substantially downward, when engaging each of the housings 312.

The coupler 322 may be comprised of a single piece of metal or steel, and may be forged of a single piece of metal. The single piece of metal can be forged with the bends in the walls as described earlier, which allows for greater strength of the coupler 322 rather than welding the walls together at weld points. However, it will be appreciated that the system 310 may be welded together with multiple metal pieces. In the instance of welding, the "bends" may be sharper, more defined, and not as curved. Additionally, and/or alternatively, the welds may be ground or sanded down to form similar bends as though the housing 12 was forged from a single piece of metal.

A width of the coupler 322 may be sized such that the coupler 322 can receive and be secured to a housing 312. Thus, the width of the coupler 322 may correspond to a width of the housing 312. In some embodiments, the width of the coupler 322 may range from approximately 5 to 12 inches, such as 6, 7, 8, 10 inches or a width within a range defined by any two of the foregoing values. Similarly, a length of the coupler 322 may be sized such that the coupler 322 adequately receives and secures two housings 312 together. In some embodiments, the length of the coupler 322 ranges from 18 inches (or 1.5 feet) to 30 inches (or 2.5 feet), such as 20, 23, 25, 28 inches or a length within a range defined by any two of the foregoing values. A height of the coupler 322 may correspond to a height of the housings 312, such that the housings 312 are substantially flush with the coupler 322 when received by the coupler 322. In some embodiments, the height of the coupler 322 may range from approximately 2 to 8 inches, such as 3, 5, 7 inches or a height within a range defined by any two of the foregoing values.

The ports 335 may be disposed at approximately a middle or center of the walls 329, 329'. For example, a height of the walls 329, 329' may be about 2.5 inches, with the ports 335 disposed about 1.2 inches from the first wall 327. In some embodiments, the ports 335 are disposed approximately 1.5 inches above the first wall 327. The disposition of the ports 335 may correspond to the placement and disposition of the holes 352 within the housing 312. The coupler holes 337 in the first wall 327 of the coupler 322 may be horizontally and/or vertically offset from each other. In some embodiments, the coupler holes 337 are offset from each other by about 2 to 4 inches, such as about 3.5 inches.

Additionally, the coupler 322 may alternatively have a 90 degree bend in the center. The bend may allow for two housings 312 to be attached, connected or engaged at 90 degrees and may traverse a 90 degree opening thus allowing for an opening on a corner of a building. While 90 degrees may be the most frequently used, it is contemplated that any angled opening or corner is considered herein from 0 to 180 degrees.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

What is claimed:

1. A system for traversing an opening, comprising:

a first elongated frame;

a second elongated frame;

a coupler for receiving and coupling the first elongated frame and the second elongated frame, the coupler comprising:

a first coupler wall with a substantially planar surface;

a pair of second coupler walls extending non-parallel from the first coupler wall, the space between the pair of second coupler walls defining a coupler channel configured to receive the first elongated frame and the second elongated frame;

a first set of coupler ports axially aligned within the second coupler walls; and a second set of coupler ports, spaced apart from the first set of coupler ports, axially aligned within the second coupler walls;

wherein the coupler channel is oriented substantially upward with the first elongated frame and second elongated frame residing within the coupler channel when the system traverses an opening; and the first elongated frame comprising:

a first planar surface;

a first longitudinal wall extending substantially perpendicular from the first planar surface, and a second longitudinal wall, opposite the first longitudinal wall, extending substantially perpendicular from the first planar surface, the first and second longitudinal walls forming a channel;

a third longitudinal wall extending substantially perpendicular from the first longitudinal wall at least partially across the channel;

a fourth longitudinal wall extending substantially perpendicular from the second longitudinal wall at least partially across the channel;

a first hole extending through a first longitudinal wall and a second hole extending through a second longitudinal wall axially aligned with the first hole and through the longitudinal walls;

a first extendable member configured to extend longitudinally beyond the first elongated frame, the first extendable member comprising:

a second planar surface substantially parallel to the first planar surface;

a first lateral wall extending substantially perpendicular to the second planar surface and a second lateral wall opposite the first lateral wall extending substantially perpendicular to the second planar surface;

a first pin passing at least partially through the first hole and the second hole, wherein the first pin is secured to the first elongated frame and the first lateral wall and second lateral wall are configured to run along the first pin;

a distal wall extending from the second planar surface, substantially perpendicular to the first and second lateral walls;

a proximal wall substantially parallel and opposite the distal wall, wherein the proximal wall extending further from the second planar surface than the distal wall and lateral walls; and a flange extending longitudinal and in the same plane as the second planar surface.

2. The system of claim 1, wherein the second elongated frame comprises:

a third planar surface;

a second elongated frame first longitudinal wall extending substantially perpendicular from the third planar surface, and a second elongated frame second longitudinal wall, opposite the second elongated frame first longitudinal wall, extending substantially perpendicular from the third planar surface, the second elongated frame first longitudinal wall and the second elongated frame second longitudinal wall forming a channel; and a second extendable member configured to extend longitudinally beyond the second elongated frame opposite the first extendable member.

3. The system of claim 2, further comprising:

a first configuration wherein the first and second extendable members are positioned within the first elongated frame and second elongated frame respectively; and a second configuration wherein the first and second extendable members are extended at least partially outside the first elongated frame and second elongated frame respectively.

4. The system of claim 1, wherein the coupler channel extends across the width of the pair of coupler walls and is configured to flushly receive the pair of longitudinal walls of the first elongated frame.

5. The system of claim 1, where the channel of the first elongated frame faces substantially downward when residing within the coupler channel when the system traverses an opening.

6. The system of claim 1, wherein the first elongated frame comprises a third hole and a fourth hole toward an opposite end from the first extendable member; wherein the third hole and fourth hole are axially aligned.

7. The system of claim 6, wherein the first set of ports axially align with the third hole and fourth hole are axially aligned-when the first elongated frame resides within the coupler.

8. The system of claim 6, wherein a second pin passes at least partially through the third hole and the fourth hole as well as the first set of ports and is secured to the coupler.

9. The system of claim 1, wherein the coupler further comprises at least one coupler hole extending through the first coupler wall configured to engage at least one support beam.

10. A system for traversing an opening, comprising:

a first elongated frame;

a second elongated frame;

a coupler for receiving and coupling the first elongated frame and the second elongated frame, the coupler comprising:

a first coupler wall with a substantially planar surface;

a pair of second coupler walls extending non-parallel from the first coupler wall, the space between the pair of second coupler walls defining a coupler channel configured to receive the first elongated frame and the second elongated frame;

a first set of coupler ports axially aligned within the second coupler walls; and a second set of coupler ports, spaced apart from the first set of coupler ports, axially aligned within the second coupler walls; and the first elongated frame comprising:

a first planar surface;

a first longitudinal wall extending substantially perpendicular from the first planar surface, and a second longitudinal wall, opposite the first longitudinal wall, extending substantially perpendicular from the first planar surface, the first and second longitudinal walls forming a channel;

at least one crossbar extending from the first longitudinal wall to the second longitudinal wall across the channel;

a first hole extending through a first longitudinal wall and a second hole extending through a second longitudinal wall axially aligned with the first hole and through the longitudinal walls;

a first extendable member configured to extend longitudinally beyond the first elongated frame, the first extendable member comprising:

a second planar surface substantially parallel to the first planar surface;

a first lateral wall extending substantially perpendicular to the second planar surface and a second lateral wall opposite the first lateral wall extending substantially perpendicular to the second planar surface;

a pair of axially aligned elongated holes passing through the first lateral wall and second lateral wall, the elongated holes extending a substantial length of the first lateral wall and second lateral wall; wherein a first pin passes at least partially through the first hole and the second hole and the pair of elongated holes and is secured to the first elongated frame, wherein the first extendable member is configured to freely slide longitudinally along the elongated holes wherein the elongated holes engage the first pin to provide a stop for the first extendable member;

a distal wall extending from the second planar surface, substantially perpendicular to the first and second lateral walls;

a proximal wall substantially parallel and opposite the distal wall; and a flange extending longitudinal and in the same plane as the second planar surface.

11. The system of claim 10, wherein the second elongated frame comprises:

a third planar surface;

a second elongated frame first longitudinal wall extending substantially perpendicular from the third planar surface, and a second elongated frame second longitudinal wall, opposite the second elongated frame first longitudinal wall, extending substantially perpendicular from the third planar surface, the second elongated frame first longitudinal wall and the second elongated frame second longitudinal wall forming a channel; and a second extendable member configured to extend longitudinally beyond the second elongated frame opposite the first extendable member.

12. The system of claim 11, further comprising:

a first configuration wherein the first and second extendable members are positioned within the first elongated frame and second elongated frame respectively; and a second configuration wherein the first and second extendable members are extended at least partially outside the first elongated frame and second elongated frame respectively.

13. The system of claim 10, wherein the coupler channel extends across the width of the pair of coupler walls and is configured to flushly receive the pair of longitudinal walls of the first elongated frame.

14. The system of claim 10, where the coupler channel is oriented substantially upward when receiving the first elongated frame and the second elongated frame when the system traverses an opening.

15. The system of claim 10, wherein the first elongated frame comprises a third hole and a fourth hole toward an opposite end from the first extendable member; wherein the third hole and fourth hole are axially aligned.

16. The system of claim 15, wherein the first set of ports axially align with the third hole and fourth hole are axially aligned when the first elongated frame resides within the coupler.

17. The system of claim 15, wherein a second pin passes at least partially through the third hole and the fourth hole as well as the first set of ports and is secured to the coupler.

18. The system of claim 10, wherein the coupler further comprises at least one coupler hole extending through the first coupler wall configured to engage at least one support beam.

* * * * *